US012161283B2

(12) United States Patent
Song et al.

(10) Patent No.: US 12,161,283 B2
(45) Date of Patent: Dec. 10, 2024

(54) NOZZLE OF CLEANER

(71) Applicant: LG ELECTRONICS INC., Seoul (KR)

(72) Inventors: Seunghyun Song, Seoul (KR); Seongmin Kim, Seoul (KR); Jaeyoung Kim, Seoul (KR); Wookjun Chung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 18/137,326

(22) Filed: Apr. 20, 2023

(65) Prior Publication Data

US 2023/0248196 A1 Aug. 10, 2023

Related U.S. Application Data

(63) Continuation of application No. 16/525,869, filed on Jul. 30, 2019, now Pat. No. 11,666,192.

(30) Foreign Application Priority Data

Jul. 30, 2018 (KR) ..... 10-2018-0088846

(51) Int. Cl.

| | |
|---|---|
| ***A47L 9/04*** | (2006.01) |
| ***A47L 9/28*** | (2006.01) |
| ***A47L 11/34*** | (2006.01) |
| ***A47L 11/40*** | (2006.01) |
| ***A47L 13/22*** | (2006.01) |

(52) U.S. Cl.

CPC ..... *A47L 9/0472* (2013.01); *A47L 9/0411* (2013.01); *A47L 9/2847* (2013.01); *A47L 11/34* (2013.01);

(Continued)

(58) Field of Classification Search

CPC .... A47L 9/0472; A47L 9/0411; A47L 9/2847; A47L 11/34; A47L 11/4088;

(Continued)

(56) References Cited

U.S. PATENT DOCUMENTS 6,490,753 B1 12/2002 Chen
8,142,094 B2 3/2012 Kaleta et al.

(Continued)

FOREIGN PATENT DOCUMENTS

CN 2803263 Y 8/2008
CN 101961222 A 2/2011

(Continued)

OTHER PUBLICATIONS

PCT International Search Report for corresponding international Application No. PCT/KR2019/009414, dated Oct. 25, 2019 (2 pages).

*Primary Examiner* — David Redding

(74) *Attorney, Agent, or Firm* — Birch, Stewart, Kolasch & Birch, LLP

(57) ABSTRACT

A nozzle of a cleaner includes a nozzle body, a rotation cleaning part having a rotation plate to which a rag is attached, a driving device provided in the nozzle body, a water tank, a water supply passage, and a water adjuster of which at least a portion is mounted on the nozzle body at a rear side thereof so as to be exposed to a rear surface or a top surface of the nozzle body. A user standing on the same floor surface as the nozzle body may manipulate the water adjuster by using his or her foot. The water adjuster can adjust an on/off operation and a rotational speed (e.g., rpm) of the pump motor.

23 Claims, 32 Drawing Sheets

(52) U.S. Cl.
CPC ..... *A47L 11/4088* (2013.01); *A47L 13/225* (2013.01); *A47L 2601/02* (2013.01)

(58) Field of Classification Search
CPC .. A47L 13/225; A47L 2601/02; A47L 9/0433; A47L 11/4069; A47L 11/4083; A47L 11/4038; A47L 11/4036; A47L 11/201; A47L 11/2025; A47L 11/4008; A47L 11/408
See application file for complete search history.

(56) References Cited

U.S. PATENT DOCUMENTS

| | | | |
|---|---|---|---|
| 2003/0233727 | A1 | 12/2003 | Wheeler et al. |
| 2005/0155850 | A1 | 7/2005 | Holsten |
| 2008/0282490 | A1 | 11/2008 | Oh |
| 2009/0252546 | A1 | 10/2009 | Kaleta et al. |
| 2016/0235266 | A1 | 8/2016 | Tomasiak |
| 2018/0242807 | A1 | 8/2018 | Lee et al. |

FOREIGN PATENT DOCUMENTS

| | | | |
|---|---|---|---|
| EP | 1 992 267 | A2 | 11/2008 |
| KR | 10-2001-0014433 | | 11/2003 |
| KR | 10-0405244 | B1 | 11/2003 |
| KR | 10-0728501 | B1 | 6/2007 |
| KR | 10-2008-0020304 | A | 3/2008 |
| KR | 10-2016-0100154 | A | 8/2016 |
| KR | 10-1655684 | B1 | 9/2016 |
| KR | 10-2016-0140460 | | 2/2017 |
| KR | 10-1710408 | B1 | 2/2017 |
| KR | 10-2017-002876 | | 3/2017 |

NOZZLE OF CLEANER

CROSS-REFERENCE TO RELATED APPLICATIONS

This application is a continuation of U.S. application Ser. No. 16/525,869, filed on Jul. 30, 2019, insert now U.S. Pat. No. 11,666,192, which claims the benefit of priority under 35 U.S.C. 119 to Korean Patent Application No. 10-2018-0088846, filed on Jul. 30, 2018, the contents of which are hereby incorporated by reference in their entirety.

BACKGROUND

The present disclosure relates to a nozzle of a cleaner.

Cleaners are devices that draw in or wipe up dust or other foreign substances on an object area to be cleaned so as to perform cleaning.

Cleaners may be classified into a manual cleaner that a user moves in person for cleaning and an automatic cleaner that automatically moves for cleaning.

Manual cleaners may fall into, depending on the types, a canister cleaner, an upright cleaner, a handy cleaner, and a stick cleaner.

Such a cleaner may clean a floor surface by using a nozzle. In general, the nozzle may be used to drawn in air and dust. Depending on the type of the nozzle, a rag may be attached to the nozzle to clean the floor with the rag.

A suction port assembly of a vacuum cleaner is disclosed in Korean Patent Registration No. 10-0405244, referred to herein as Related Art Document 1.

The suction port assembly that is disclosed in Related Art Document 1 includes a suction port body provided with a suction port.

The suction port body includes a first suction path in the front, a second suction path in the rear, and a guide passage provided between the first suction path and the second suction path.

Also, a rag is rotatably installed on a lower end of the suction port body, and a rotation driving part for driving the rag is provided inside the suction port body.

The rotation driving part includes one rotary motor and gears for transmitting power of the rotary motor to a plurality of rotation bodies to which the rag is attached.

However, according to Related Art Document 1, since a pair of rotation bodies disposed on both sides rotate by using one rotary motor, both rotation bodies of the pair may not rotate if the rotary motor fails or malfunctions.

Also, since the suction port body is disposed at a central portion so that the pair of rotation bodies rotate by using the one rotary motor, it is necessary to design a suction path which does not interfere with the rotary motor. As a result, the suction path may be elongated, and a structure for forming the suction path may be complicated.

Also, in Related Art Document 1, since a structure for supplying water to the rag is not provided, the user has to directly supply water to the rag to perform cleaning with a wet rag.

A cleaner is disclosed in Korean Patent Publication No. 10-2017-0028765, referred to herein as Related Art Document 2.

The cleaner disclosed in Related Art Document 2 includes a cleaner body on which a rag is rotatably installed on a lower portion thereof, a handle connected to the cleaner body or a water tank mounted on the cleaner body, a water injection nozzle installed to spray water from a front surface of the cleaner body, and a water supply part supplying water of the water tank to the water injection nozzle.

In the case of Related Art Document 2, since the water injection nozzle sprays the water from the front surface of the cleaner body, the injected water may wet other peripheral structures instead of the rag.

Also, since the water injection nozzle is disposed at a center of the cleaner body, but the rag is arranged horizontally, the water sprayed from the front surface of the cleaner body is not sufficiently absorbed by the rag.

In addition, in the case of Related Art Document 2, since a passage through which air is drawn in is not provided, the cleaner may only wipe the floor surface, but foreign substances existing on the floor surface have to be manually picked up again by the user.

A damp cloth cleaner is disclosed in Korean Patent Registration No. 10-1710408, referred to herein as Related Art Document 3.

The cleaner disclosed in Related Art Document 3 includes a handle part provided with a power button and an injection button at one side thereof, a body part disposed to be angled at a predetermined angle with respect to the handle part, a head part hinge-coupled to the body part so as to be angularly adjustable, and a rag attached to a bottom surface of the head part. Here, when the user pushes a button of the handle, a water pump is driven to supply water of a water tank to the head part to which the rag is attached.

In the case of Related Art Document 3 as described above, since the button has to be pushed in a state in which the user holds the handle, all manipulations may be performed by using the user's hands, and thus, fatigue of the user's hands may increase.

Also, in the case of Related Art Document 3, when the user pushes the button, the water pump is driven at a constant rate, and a certain amount of water is discharged from the water tank. Thus, a user may hold the button down longer to discharge more water rather than manipulating the button several times to increase the amount of water.

SUMMARY

Exemplary embodiments of the present disclosure may provide a nozzle of a cleaner that may be capable of drawing in foreign substances on a floor surface, cleaning the floor through rotation of a rag, and supplying water to the rag.

Exemplary embodiments may also provide a nozzle of a cleaner in which water of a water tank may be stably supplied to a rotation cleaning part during a cleaning process.

Exemplary embodiments may also provide a nozzle of a cleaner in which water discharged through a water supply passage may be prevented from being introduced into a nozzle body.

Exemplary embodiments may also provide a nozzle of a cleaner in which a water supply passage for supplying water of a water tank to a rotation cleaning part may be minimized in length.

Exemplary embodiments may also provide a nozzle of a cleaner in which leakage of water discharged from a water tank may be minimized.

Exemplary embodiments may also provide a nozzle of a cleaner in which the same amount of water may be supplied to each of rotation cleaning parts.

Exemplary embodiments may also provide a nozzle of a cleaner that may be capable of easily adjusting an amount of water per unit time, which may be supplied to a rag, by using a user's hand and foot during a cleaning process.

Exemplary embodiments may also provide a nozzle of a cleaner that may be capable of supplying water of a water tank to a rag or cutting off the water supplied to the rag through simple manipulation using a user's hand or food during a cleaning process.

In one exemplary embodiment, a nozzle of a cleaner may include: a nozzle body provided with a suction passage configured to draw in air; a rotation cleaning part rotatably disposed below the nozzle body, the rotation cleaning part being provided with a rotation plate to which a rag may be attached; and a driving device provided in the nozzle body, the driving device comprising a driving motor configured to drive the rotation cleaning part.

The nozzle of the cleaner may include: a water tank separably mounted on an upper portion of the nozzle body, the water tank being configured to store water to be supplied to the rotation cleaning part; and a water supply passage provided in the nozzle body to communicate with the water tank, the water supply passage being configured to supply the water of the water tank to the rotation cleaning part.

The water tank may be separably connected to the nozzle body.

The rag may be attached to a lower portion of the rotation plate, and a plurality of water passing holes through which the water discharged from the water supply passage passes may be formed in the rotation plate.

The plurality of water passing holes may be arranged to be spaced apart from each other in a circumferential direction with respect to a rotation center of the rotation plate so that the water may be stably supplied to the rotation cleaning part.

An injection nozzle may be disposed on an end of the water supply passage, and a nozzle end of the injection nozzle may be disposed to face the rotation plate.

The nozzle body may include a nozzle housing in which the driving device may be accommodated. The nozzle end of the injection nozzle may pass through a lower portion of the nozzle housing so as to be exposed to the outside of the nozzle housing, thereby preventing the water discharged from the injection nozzle from being introduced into the nozzle housing.

The nozzle housing may include a groove having a recessed shape so that the nozzle end exposed to the outside of the nozzle housing may be disposed therein, and a nozzle hole through which the nozzle end passes may be formed in the groove.

The water tank may include: a tank body including a chamber in which water may be stored and a discharge hole through which water may be discharged; and a valve including a switching part that opens and closes the discharge hole within the tank body.

The nozzle body may include a valve manipulation part that operates the switching part to allow the switching part to open the discharge hole while the water tank may be mounted on the nozzle body.

The water supply passage may be connected to the valve manipulation part to supply the water discharged through the discharge hole to the rotation cleaning part.

The water supply passage may include: a water pump controlling the water discharge from the water tank; and a pump motor that drives the water pump.

The rotation cleaning part may include a first rotation cleaning part and a second rotation cleaning part, which are arranged in the horizontal direction, and the driving device may include: a first driving device that drives the first rotation cleaning part; and a second driving device that drives the second rotation cleaning part.

The water supply passage may include: a supply tube through which the water discharged from the water tank flows; a connector connected to the supply tube; a first branch tube connected to the connector to supply the water to the first rotation cleaning part; and a second branch tube connected to the connector to supply the water to the second rotation cleaning part.

An injection nozzle may be disposed in each of the first branch tube and the second branch tube, and the nozzle end of the injection nozzle may be disposed to face each of the rotation cleaning parts.

The nozzle end of the injection nozzle may be disposed to face the rotation plate.

The supply tube may include: a first supply tube connected to an inlet of the water pump; and a second supply tube connected to an outlet and the connector.

The connector may include: a first connection part to which the second supply tube may be connected; a second connection part to which the first branch tube may be connected; and a second connection part to which the second branch tube may be connected.

The suction passage may include: a first passage extending horizontally from a front end of the nozzle body; and a second passage extending in a front-rear direction from a central portion of the first passage.

The second passage may divide the nozzle body into left and right parts, and the discharge hole and the water pump may be disposed at one side of both sides of the second passage.

The nozzle body may further include a passage formation part providing the second passage, and the connector may be disposed above the passage formation part so that the water may be uniformly distributed from the connector to each of the branch tubes.

The nozzle of the cleaner may include a water adjuster of which at least a portion may be mounted on the nozzle body at a rear side of the nozzle body so as to be exposed to a rear surface or a top surface of the nozzle body so that a user standing on the same floor surface as the nozzle body may manipulate the water adjuster by using a foot, the water adjuster being configured to adjust an on/off operation and a rotation speed (e.g., rpm) of the pump motor.

The water adjuster may include a water adjusting switch disposed outside the nozzle body to receive pressing force in a front-rear direction through a user's hand or foot.

The water adjusting switch may rotate with respect to a vertical central axis, and the water adjusting switch may include: a first push part disposed at one side of the water adjusting switch to receive pressing force pressed forward by the user; and a second push part integrated with the first push part, the second push part being disposed at the other side of the water adjusting switch to receive pressing force pressed forward by the user.

The pump motor may rotate at a first rotation speed (rpm) in the state in which the first push part may be pressed and rotate at a second rotation speed (rpm) greater than the first rotation speed (rpm) in the state in which the second push part may be pressed.

In a state in which the first push part and the second push part are not pressed, the water adjusting switch may be disposed at the center, and the pump motor may be turned off.

The water adjuster may include a control substrate disposed inside the nozzle body between the water adjusting switch and the pump motor.

The control substrate may include: a first element receiving the pressing force applied to the first push part to transmit a driving signal to the pump motor; and a second element receiving the pressing force applied to the second push part to transmit a driving signal to the pump motor.

The water adjuster may include a water adjusting lever disposed outside the nozzle body to receive pressing force in a vertical direction through a user's hand or foot.

The water adjusting lever may rotate vertically with respect to a horizontal central axis.

The water adjusting lever may rotate vertically with a central axis in a front-rear direction.

The water adjusting lever may protrude backward, and a top surface and a bottom surface of the water adjusting lever may provide a plane.

The pump motor may operate in a first mode in a state in which the water adjusting lever is pressed to descend and operate in a second mode in a state in which the water adjusting lever is lifted to ascend.

In a state in which the water adjusting lever is disposed at a center position, the pump motor may be stopped or operate in a third mode.

The water adjuster may include a touch button disposed outside the nozzle body so that a water adjusting command is input in a touch manner through a user's hand or foot.

The water adjuster may include a display part that emits light to a rear side of the nozzle body to display various states of the pump motor to the outside.

The details of one or more exemplary embodiments are set forth in the accompanying drawings and the description below. Other features will be apparent from the description and drawings, and from the claims.

DETAILED DESCRIPTION

Figure 1:
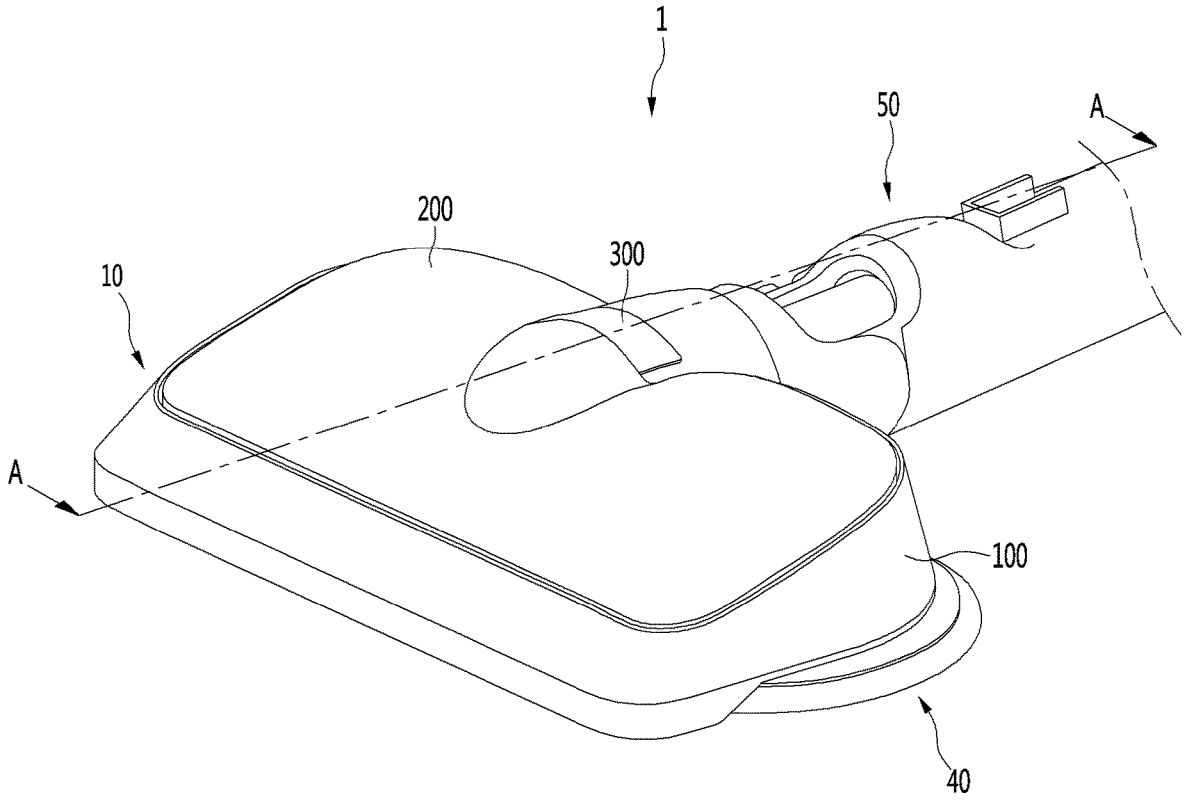
FIGS. 1 and 2 are perspective views illustrating a nozzle of a cleaner according to an exemplary embodiment.

Hereinafter, exemplary embodiments of the present disclosure will be described in detail with reference to the accompanying drawings. It should be noted that when components in the drawings are designated by reference numerals, the same components have the same reference numerals as far as possible even though the components are illustrated in different drawings. Further, in describing the exemplary embodiments of the present disclosure, detailed descriptions of well-known configurations or functions may be omitted for conciseness and clarity.

Also, in the description of the exemplary embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 2:
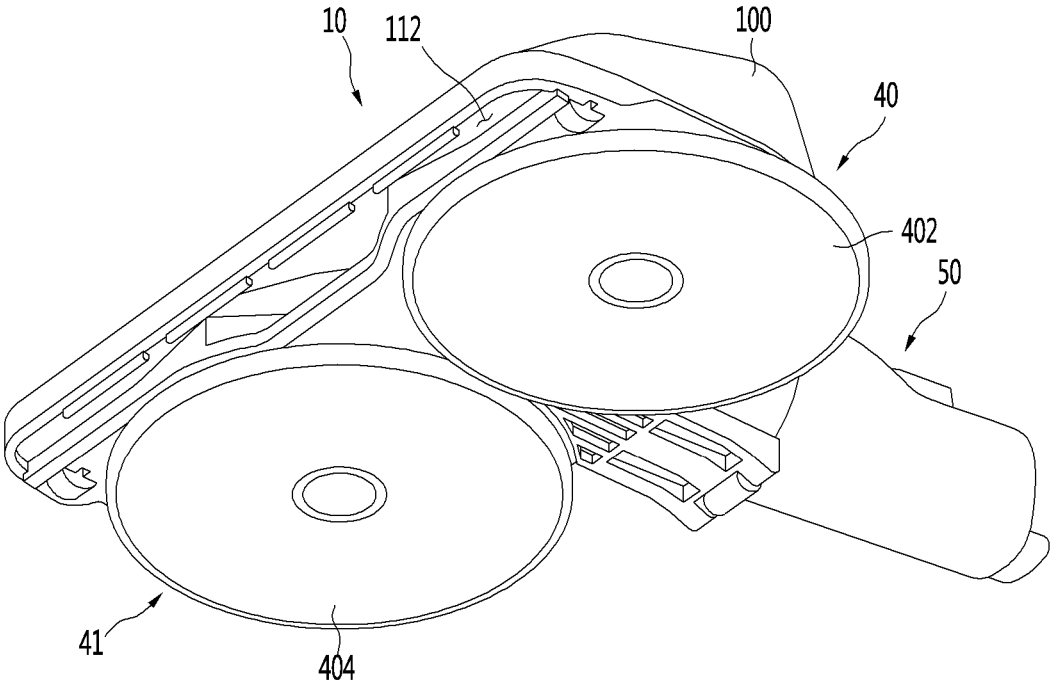
Figure 3:
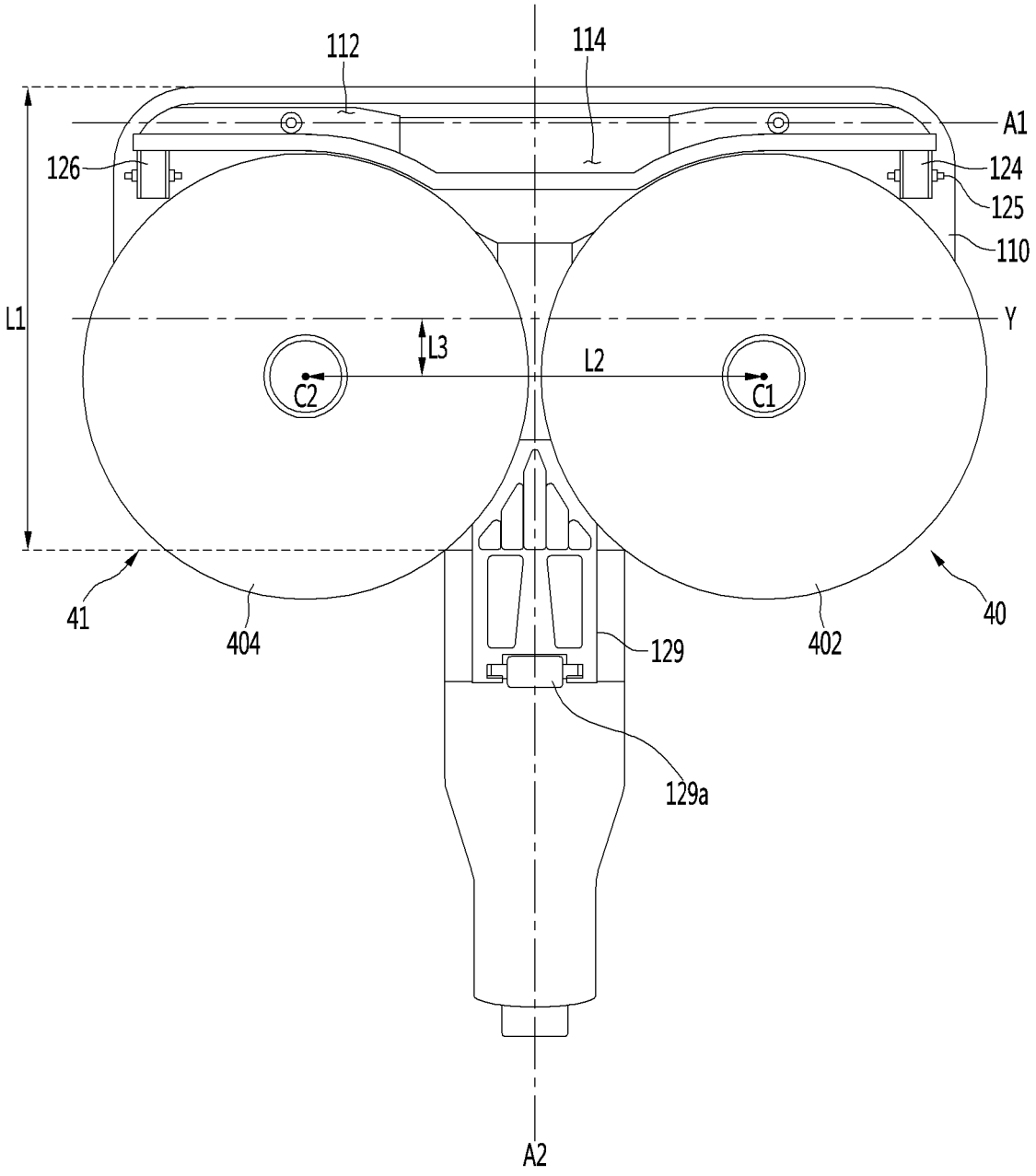
FIG. 3 is a bottom view illustrating the nozzle of the cleaner according to an exemplary embodiment.
Figure 4:
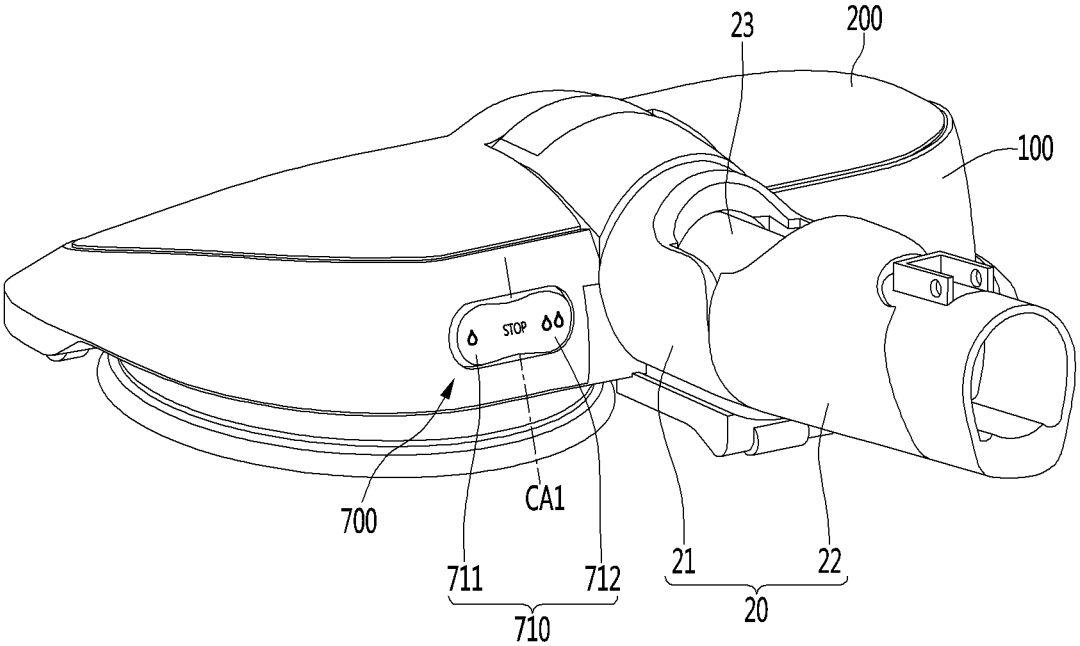
FIG. 4 is a perspective view illustrating the nozzle of the exemplary cleaner of FIG. 1 when viewed from a rear side.
Figure 10:
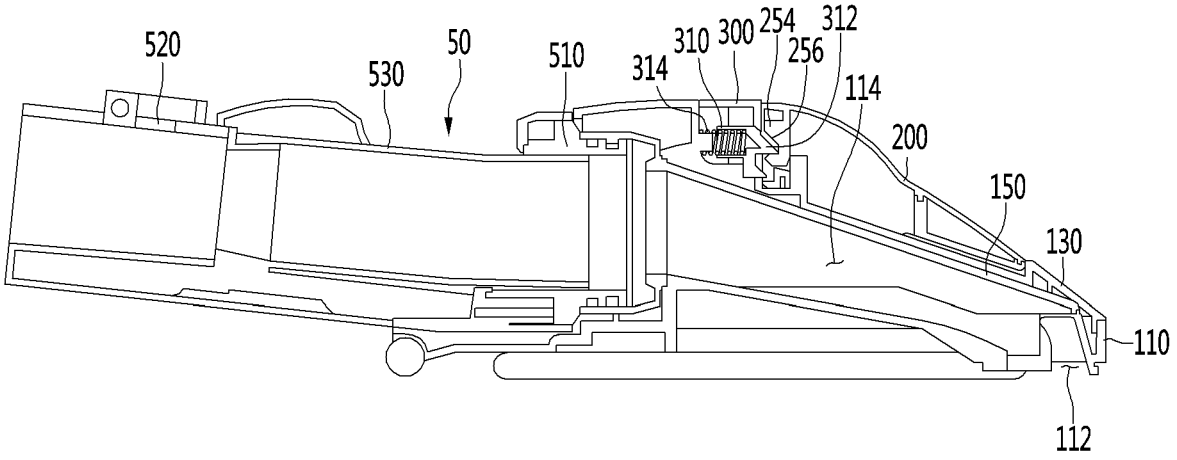
FIG. 10 is a cross-sectional view taken along line A-A' of FIG. 1.

FIGS. 1 and 2 are perspective views illustrating a nozzle of a cleaner according to an exemplary embodiment, FIG. 3 is a bottom view illustrating the nozzle of the cleaner according to an exemplary embodiment, FIG. 4 is a perspective view illustrating the nozzle of the cleaner of FIG. 1 when viewed from a rear side, and FIG. 10 is a cross-sectional view taken along line A-A' of FIG. 1.

Referring to FIGS. 1 to 4 and 10, a nozzle 1 of a cleaner (hereinafter, referred to as a "nozzle") according to an exemplary embodiment may include a nozzle body 10 and a connection tube 50 movably connected to the nozzle body 10.

The nozzle according to the disclosed exemplary embodiment may be connected to, for example, a handy cleaner or a canister cleaner. A connecting arm 20 may include a first connecting part 21 and a second connecting part 22. There may also be provided an intermediary part 23.

The nozzle 1 may have a battery to supply power to a power consumption part or may receive power from the cleaner to operate.

Since the cleaner to which the nozzle 1 is connected may include a suction motor, suction force generated by the suction motor may act on the nozzle 1 to draw in foreign substances and air on a floor surface through the nozzle 1.

Thus, in the disclosed exemplary embodiment, the nozzle 1 may draw in foreign substances and air and guide the foreign substances and air to the cleaner.

Although not limited, the connection tube 50 may be connected to a central portion of a rear side of the nozzle body 10 to guide the drawn in air to the cleaner.

The nozzle 1 may further include a rotatable cleaning member. The nozzle 1 may include, for example, rotation cleaning parts 40 and 41 that are rotatably provided below the nozzle body 10.

For example, the pair of rotation cleaning parts 40 and 41 may be arranged in a horizontal direction. The pair of rotation cleaning parts 40 and 41 may be arranged in a horizontal plane that may be parallel to a floor surface. The pair of rotation cleaning parts 40 and 41 may rotate independently. For example, the nozzle 1 may include a first rotation cleaning part 40 and a second rotation cleaning part 41.

Each of the rotation cleaning parts 40 and 41 may include rags 402 and 404. Each of the rags 402 and 404 may have, for example, a circular plate shape. The rags 402 and 404 may include a first rag 402 and a second rag 404.

The nozzle body 10 may include a nozzle housing 100 defining an outer appearance thereof. The nozzle housing 100 may provide suction passages (e.g., a first passage 112 and a second passage 114) through which air may be drawn in.

The suction passages may include a first passage 112 extending from the nozzle housing 100 in a horizontal direction (e.g., left-right direction in the view of FIG. 3) and a second passage 114 communicating with the first passage 112 to extend in a front-rear direction (e.g., up-down direction in the view of FIG. 3).

For example, the first passage 112 may be provided in a front portion of a bottom surface of the nozzle housing 100.

The second passage 114 may extend backward from the first passage 112. For example, the second passage 114 may extend backward from a central portion of the first passage 112 to the connection tube 50.

Thus, a central line A1 of the first passage 112 may extend in the horizontal direction. Also, a central line A2 of the second passage 114 may extend in the front-rear direction to cross the central line A1 of the first passage 112.

The central line A2 of the second passage 114 may be disposed, for example, at a point at which the nozzle body 10 is bisected between left and right sides.

When the rotation cleaning parts 40 and 41 are connected to a lower portion of the nozzle body 10, some of the rags 402 and 404 may protrude to the outside of the nozzle 1 to clean a floor surface that is disposed directly below the nozzle 1 and a floor surface disposed outside the nozzle 1.

For example, the rags 402 and 404 may protrude to a rear side of the nozzle 1 as well as both lateral sides of the nozzle 1.

For example, the rotation cleaning parts 40 and 41 may be disposed at a rear side of the first passage 112 below the nozzle body 10.

Thus, when the nozzle 1 is advanced for cleaning, the foreign substances and air on the floor surface may be drawn in by the first passage 112, and thus, the floor surface may be cleaned by the rags 402 and 404.

In the disclosed exemplary embodiment, a first rotation center C1 (for example, a rotation center of a rotation plate 420) of the first rotation cleaning part 40 and a second rotation center C2 (for example, a rotation center of a rotation plate 440) of the second rotation cleaning part 41 may be disposed to be spaced apart from each other in the horizontal direction.

The central line A2 of the second passage 114 may be disposed between the first rotation center C1 and the second rotation center C2.

A central axis Y that bisects a front-rear length L1 of the nozzle body 10 (except for an extension part) may be disposed in front of each of the rotation centers C1 and C2 of the rotation cleaning parts 40 and 41. That is, the central axis Y that bisects the front-rear length L1 of the nozzle body 10 may be closer to the front end of the nozzle body than each of central centers C1 and C2 of the rotation cleaning parts 40 and 41. This may be done for preventing the rotation cleaning parts 40 and 41 from blocking the first passage 112.

Thus, a distance L3 between the central axis Y and each of the rotation centers C1 and C2 of the rotation cleaning parts 40 and 41 may be set to a value greater than zero.

Also, a distance L2 between the rotation centers C1 and C2 of the rotation cleaning parts 40 and 41 may be greater than a diameter of each of the rags 402 and 404. This is done for preventing the rags 402 and 404 from interfering with each other during the rotation of the rags 402 and 404 to reduce mutual friction, and for preventing an area to be cleaned from being reduced due to the interference.

Although not limited, each of rags 402 and 404 may have a diameter 0.6 times or more than half the width of the nozzle body 10 in the horizontal direction. In this case, a contact area between each of the rags 402 and 404 and the floor surface to be cleaned, which faces the nozzle body 10, may increase, and also, an area that is capable of being cleaned, which does not face the nozzle body 10, may increase. Also, when the cleaning is performed using the nozzle 1, the area to be cleaned may be secured by using a small amount of movement.

The nozzle housing 100 may include a nozzle base 110 and a nozzle cover 130 coupled to an upper portion of the nozzle base 110.

The nozzle base 110 may provide the first passage 112. The nozzle housing 100 may further include a passage formation part 150 that provides the second passage 114 together with the nozzle base 110.

The passage formation part 150 may be coupled to a central portion of an upper side of the nozzle base 110 and have an end connected to the connection tube 50.

The second passage 114 may extend forward and backward in an approximately straight-line shape by the arrangement of the passage formation part 150. Thus, the second passage 114 may be minimized in length, and a loss of the passage in the nozzle 1 may be minimized.

A front portion of the passage formation part 150 may cover an upper side of the first passage 112. The passage formation part 150 may be disposed to be inclined upward from a front end to a rear side thereof.

Thus, the front portion of the passage formation part 150 may have a height less than that of a rear portion thereof.

According to the disclosed exemplary embodiment, since the front portion of the passage formation part 150 has a relatively low height, the height of the front portion in the total height of the nozzle 1 may be reduced. As the nozzle 1 decreases in height, the nozzle 1 may be inserted into a narrow space under furniture or a chair to be cleaned.

The nozzle base 110 may include an extension part 129 for supporting the connection tube 50. The extension part 129 may extend backward from a rear end of the nozzle base 110.

The connection tube 50 may include a first connection tube 510 connected to an end of the passage formation part 150, a second connection tube 520 rotatably connected to the first connection tube 510, and a guide tube 530 allowing the first connection tube 510 and the second connection tube 520 to communicate with each other.

The first connection tube 510 may be seated on the extension part 129, and the second connection tube 520 may be connected to an extension tube or a hose of the cleaner.

A plurality of rollers for smooth movement of the nozzle 1 may be provided below the nozzle base 110.

For example, in the nozzle base 110, a first roller 124 and a second roller 126 may be disposed behind the first passage 112. The first roller 124 and the second roller 126 may be spaced part from each other in the horizontal direction.

According to the disclosed exemplary embodiment, since the first roller 124 and the second roller 126 may be disposed behind the first passage 112, the first passage 112 may be disposed as close as possible to the front end of the nozzle base 110 so that the area to be cleaned using the nozzle 1 increases.

As the distance from the front end of the nozzle base 110 to the first passage 112 increases, the area on which suction force does not act in front of the first passage 112 during the cleaning may increase, and thus, an area on which the cleaning is not performed may increase.

On the other hand, the distance from the front end of the nozzle base 110 to the first passage 112 may be minimized, and thus, the area to be cleaned may increase.

Also, since the first roller 124 and the second roller 126 are disposed behind the first passage 112, the horizontal length of the first passage 112 may be maximized.

That is, a distance between each of both ends of the first passage 112 and each of both ends of the nozzle base 110 may be minimized.

In the disclosed exemplary embodiment, the first roller 124 may be disposed in a space between the first passage 112 and the first rag 402. Also, the second roller 126 may be disposed in a space between the first passage 112 and the second rag 404.

Each of the first roller 124 and the second roller 126 may be rotatably connected to a shaft 125. The shaft 125 may be fixed to a lower side of the nozzle base 110 in a state of extending in the horizontal direction.

A distance between the shaft 125 and the front end of the nozzle base 110 may be greater than that between each of the rags 402 and 404 (or a rotation plate that will be described later) and the front end of the nozzle base 110.

For example, at least a portion of each of the rotation cleaning parts 40 and 41 (e.g., the rag and/or the rotation plate) may be disposed between the shaft 125 of the first roller 124 and the shaft 125 of the second roller 126.

Due the above-described arrangement, the rotation cleaning parts 40 and 41 may be disposed as close as possible to the first passage 112. Thus, the area to be cleaned by the rotation cleaning parts 40 and 41 on the floor surface on which the nozzle 1 is disposed may increase to improve floor cleaning performance.

Although only two rollers have been described above, the disclosed exemplary embodiments may not be so limited and may include more than two rollers. For example, a plurality of rollers may support the nozzle 1 at three points. That is, the plurality of rollers may further include a third roller **129*a* provided on the extension part 129 of the nozzle base 110**.

Also, the third roller **129*a* may be disposed behind the rags 402 and 404 to prevent interference with the rags 402 and 404**.

The nozzle body 10 may further include a tank configured to store a fluid. The tank may include a water tank 200 that may supply water to the rags 402 and 404.

The water tank 200 may be separately connected to the nozzle housing 100. When the water tank 200 is mounted on the nozzle housing 100, water of the water tank 200 may be supplied to each of the rags 402 and 404.

The nozzle body 10 may further include a manipulation part 300 through which the nozzle body 10 is separated when the water tank 200 is mounted on the nozzle housing 100.

For example, the manipulation part 300 may be disposed on the nozzle housing 100. A first coupling part 310 to be coupled to the water tank 200 may be disposed on the nozzle housing 100, and a second coupling part 254 to be coupled to the first coupling part 310 may be disposed on the water tank 200.

The manipulation part 300 may be disposed on the nozzle housing 100 so as to be vertically movable. The first coupling part 310 may be disposed below the manipulation part 300 to receive manipulation force of the manipulation part 300 so as to be movable.

For example, the first coupling part 310 may be movable forward and backward. For this, the manipulation part 300 and the first coupling part 310 may have inclined surfaces that contact each other, respectively.

When the manipulation part 300 descends by action of the inclined surfaces, the first coupling part 310 may move horizontally (for example, move forward and backward).

The first coupling part 310 may include a hook 312 coupled to the second coupling part 254, and the second coupling part 254 may include a groove 256 into which the hook 312 may be inserted.

The first coupling part 310 may be elastically supported by an elastic member 314 so that the coupled state between the first coupling part 310 and the second coupling part 254 may be maintained.

Thus, the hook 312 may be in a state of being inserted into the groove 256 by the elastic member 314. When the manipulation part 300 is pressed downward, the hook 312 may be separated from the groove 256. When the hook 312 is separated from the groove 256, the water tank 200 may be separated from the nozzle housing 100.

In the disclosed exemplary embodiment, for example, the manipulation part 300 may be disposed directly above the second passage 114. For example, the manipulation part 300 may be disposed to vertically overlap the central line A2 of the second passage 114.

<Water Adjuster>

The nozzle body 10 may further include a water adjuster 700 that adjusts an on-off operation and an operation speed (e.g., a rotation speed in rpm) of a pump motor 280. The water adjuster 700 may include a switch.

Also, the water adjuster 700 may include adjusting parts 710, 720, and 730 mounted on the nozzle body 10 so that at least a portion of the water adjuster 700 is exposed to a rear surface or a top surface of the nozzle body 10.

As described above, when the adjusting parts 710, 720, and 730 are exposed to the rear surface or the top surface of the nozzle body 10, a user standing behind the nozzle body 10 may manipulate the adjusting parts 710, 720, and 730 by using his/her foot. Here, the user may stand on the same floor surface as the bottom surface on which the nozzle body 10 is placed.

For example, the adjusting parts 710, 720, and 730 may be disposed at a rear side (a direction facing the user's foot) of the nozzle body 10. An amount of water discharged from the water tank 200 may be adjusted by the adjusting parts 710, 720, and 730. Also, whether the water is discharged from the water tank 200 may be manipulated.

The adjusting parts 710, 720, and 730 may be manipulated by using the user's hand or foot. The water of the water tank 200 may or may not be discharged by manipulating the adjusting parts 710, 720, and 730.

Alternatively, the adjusting parts 710, 720, and 730 may be manipulated by using the user's hand or foot to adjust an amount of water discharged from the water tank 200. For example, as the adjusting parts 710, 720, and 730 are manipulated, water may be discharged from the water tank 200 by a first amount per unit time, or water may be discharged by a second amount greater than the first amount per unit time. As described above, the adjustment of the amount of water to be discharged through the adjusting parts 710, 720, and 730 may be performed in several stages.

According to the disclosed exemplary embodiment, the water adjuster 700 may be disposed at a left side with respect to a center of the nozzle body 10 in the front-rear direction. Here, the "left side" may represent a left side when the nozzle body 10 is viewed from the rear side of the nozzle body 10, at which the connection tube 50 is disposed.

In general, the user may hold a handle (not shown) of the cleaner by using his/her right hand. Also, the handle (not shown) of the cleaner may be connected to the connection tube 50 that is disposed at a center of the nozzle body 10.

Also, when the user holds the handle of the cleaner to perform the cleaning in the standing state of the user, the center of the nozzle body 10, at which the connection tube 50 is disposed, may be disposed on the right side of the user. Also, the left side of the nozzle body 10 may be disposed in front of the user with respect to the front-rear direction.

In detail, the left side of the nozzle body 10 may be disposed at the front side of the right foot of the user.

Thus, if the water adjuster 700 is disposed at the left side with respect to the center of the nozzle body 10, when the user holds the handle of the cleaner in his/her right hand to perform the cleaning, the water adjuster 700 may be disposed at the front side of the right foot of the user, and thus, the user may easily manipulate the water adjuster 700.

Also, when the water adjuster 700 is disposed at the left side with respect to the center of the nozzle body 10, while the user may hold the handle of the cleaner by using his/her right hand to perform the cleaning, the position and state of the water adjuster 700 may be confirmed in real time without any interference.

For reference, when the water adjuster 700 is disposed at the right side with respect to the center of the nozzle body 10, the following limitations may be encountered.

First, when the water adjuster 700 is disposed at the right side of the nozzle body 10, the water adjuster 700 may be covered by the connection tube 50 disposed at the center of the nozzle body 10 when the user holds the handle of the cleaner in his/her right hand to perform the cleaning. Thus, during the cleaning, there is a limitation that it is difficult for the user to check the position and state of the water adjuster 700 in real time.

Also, when the water adjuster 700 is disposed at the right side of the nozzle body 10, when the user manipulates the water adjuster 700 while holding the handle of the cleaner in his/her right hand to perform the cleaning, it may be difficult to manipulate the water adjuster 700 due to the interference with the connection tube 50 disposed at the center of the nozzle body 10, and also, it may be cumbersome for the user to have to move to the right side to manipulate the water adjuster 700.

<Adjusting Part>

Here, the adjusting parts 710, 720, and 730 may be realized according to various exemplary embodiments. Each of the adjusting parts 710, 720, and 730 may linearly or rotatably move in the horizontal direction, the front-rear direction, or the vertical direction with respect to the nozzle body 10.

As described above, when the adjusting parts 710, 720, and 730 move linearly or rotatably in the horizontal direction, the front-rear direction, or the vertical direction, the user may drive the adjusting parts 710, 720, and 730 by using a hand or foot.

The adjusting parts 710, 720, and 730 may be disposed on one side of the rear surface of the nozzle body 10. Also, while the cleaning is performed, the user's foot may be disposed behind the nozzle body 10. Here, the adjusting parts 710, 720, and 730 may operate through the user's foot. In detail, while the adjusting parts 710, 720, and 730 linearly or rotatably move in the horizontal direction, the front-rear direction, or the vertical direction by using the user's foot, water may be discharged from the water tank 200 or may not be discharged from the water tank 200. Also, the water discharged from the water tank 200 may be discharged by the first amount per unit time or discharged by the second amount greater than the first amount per unit time.

Hereinafter, the adjusting parts 710, 720, and 730 according to various exemplary embodiments will be described.

<Water Adjusting Switch>

The water adjuster 700 may include the adjusting part 710 that may be disposed outside the rear side of the nozzle body to receive forward and backward pressing force through the user's hand or foot. The adjusting part 710 may include a water adjusting switch. The adjusting part 710 may rotate about a vertical central axis CA1. Here, the central axis CA1 may be perpendicularly or inclinedly defined. Also, the adjusting part 710 may rotate in units of about 10 degrees.

As described above, when the adjusting part 710 receives the pressing force forward and backward, the user may easily manipulate the adjusting part 710 by using the user's hand or foot. In detail, the user may manipulate the adjusting part 710 in a manner in which the user pushes forward one side or the other side of the adjusting part 710 that is in a state of protruding backward.

Here, water may or may not be discharged from the water tank 200 through the adjusting part 710 based on the number of times a user pushes the adjusting part 710.

Also, water may be discharged from the water tank 200 through the adjusting part 710 by the first amount per unit time or the second amount greater than the first amount per unit time according to the number of times the adjusting part 710 is pushed by the user.

For example, in the state in which the water is not discharged from the water tank 200, when the user pushes the adjusting part 710 once, the adjusting part 710 may be configured so that water is discharged from the water tank 200 by the first amount per unit time, and when the user pushes the adjusting part 710 twice, the adjusting part 710 may be configured so that water is discharged from the water tank 200 by the second amount greater than the first amount per unit time.

Also, when the user pushes the adjusting part 710 three times, water may not be discharged from the water tank 200.

Also, the adjusting part 710 may include a first push part 711 that rotates about the vertical central axis C1 and is disposed on one side of the adjusting part 710 to receive the pressing force applied forward by the user and a second push part 712 that is integrated with the first push part 711 and is disposed on the other side of the adjusting part 710 to receive the pressing force applied forward by the user.

When the adjusting part 710 is provided as described above, the user may simply manipulate the first push part 711 and the second push part 712 forward by using his/her hand or foot so that the water is discharged or is not discharged from the water tank 200.

Also, the water may be discharged from the water tank 200 by the first amount per unit time or discharged by the second amount greater than the first amount per unit time.

Figure 5A:
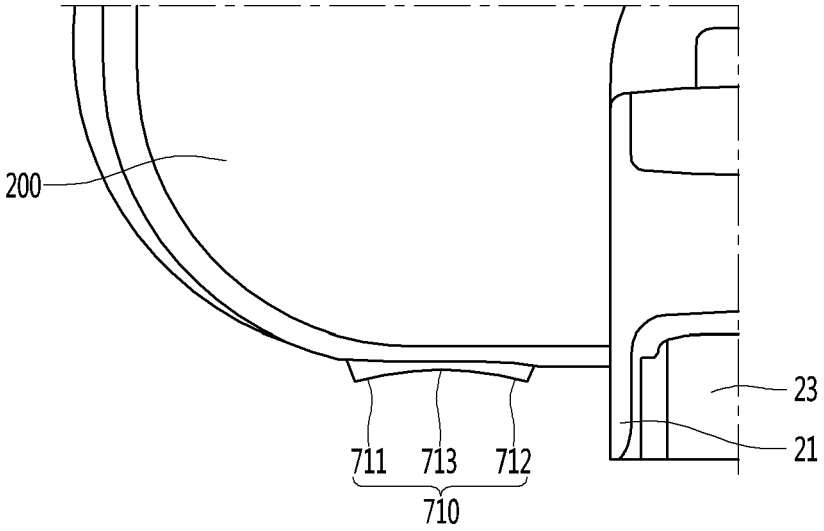
FIGS. 5A, 5B and 5C are views illustrating various manipulation states of a water adjusting switch of FIG. 4 when viewed from an upper side of a nozzle body.
Figure 5B:
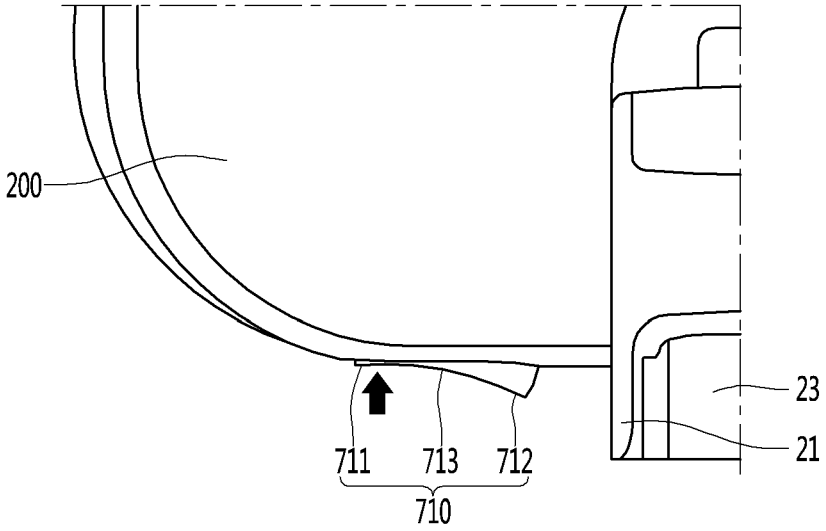
Figure 5C:
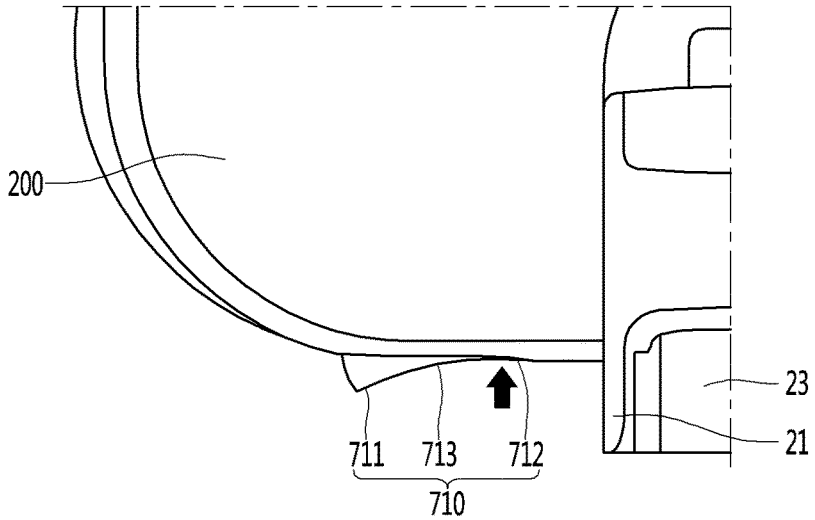

FIG. 5 is a view illustrating various manipulation states of the adjusting part 710 of FIG. 4 when viewed from an upper side of the nozzle body 10.

In detail, as illustrated in FIG. 5(*b*), in the state in which the first push part 711 is pressed by the user, the pump motor 280 may rotate at a first rotation speed (rpm). Also, as illustrated in FIG. 5(*c*), in the state in which the second push part 712 is pressed, the pump motor 280 may rotate at a second rotation speed (rpm) greater than the first rotation speed (rpm).

For example, as illustrated in FIG. 5(*c*), when the user pushes the first push part 711, water may be discharged from the water tank 200 by the first amount per unit time. As illustrated in FIG. 5(*c*), when the user pushes the second push part 712, water may be discharged from the water tank 200 by the second amount greater than the first amount per unit time.

As illustrated in FIG. 5(*a*), in the state in which the first push part 711 and the second push part 712 are not pressed, the adjusting part 710 may be disposed at the center, and the pump motor 280 may be turned off.

That is, in the state in which the adjusting part 710 is disposed at the center as illustrated in FIG. 5(*a*), water may not be discharged, and then, when the user pushes the first push part 711 disposed at the left side of the water adjusting part 710 to cause the adjusting part 710 to rotate to the left side, water may be discharged from the water tank 200 by the first amount per unit time. Also, when the user pushes the second push part 712 disposed at the right side of the adjusting part 710 to cause the adjusting part 710 to rotate to the right side, water may be discharged from the water tank 200 by the second amount per unit time. A configuration for detecting the manipulation of the adjusting part 710 will be described with reference to the accompanying drawings.

Also, as illustrated in FIG. 5(*a*), in the state in which the first push part 711 and the second push part 712 are not pressed, a groove part 713 having an inwardly recessed shape may be formed in a central portion between the first push part 711 and the second push part 712.

For example, the adjusting part 710 may have a curved shape.

When the groove part 713 is formed as described above, the first push part 711 and the second push part 712 may protrude relatively outward. Also, the first push part 711 and the second push part 712, which protrude outward, may be more easily pressed by using the user's foot.

Also, the water adjuster 700 may include a control substrate 750 disposed inside the nozzle body 10 between the adjusting part 710 and the pump motor 280.

Also, the control substrate 750 may include a first element 751 (see FIG. 11) that is disposed to face a rear end of the first push part 711 and receives the pressing force applied to the first push part 711 to transmit a driving signal to the pump motor 280 and a second element 752 (see FIG. 11) that is disposed to face a rear end of the second push part 712 and receives the pressing force applied to the second push part 712 to transmit a driving signal to the pump motor 280.

Here, each of the first element 751 and the second element 752 may be provided as a switching element.

Thus, when the user pushes the first push part 711 of the adjusting part 710, the first element 751 may be pressed and may transmit a corresponding signal (a first signal) to the pump motor 280, and thus, the pump motor 280 may operate at a first output. Thus, water may be discharged from the water tank 200 by the first amount per unit time.

On the other hand, when the user pushes the second push part 712 of the adjusting part 710, the second element 752 may be pressed and may transmit a corresponding signal (a second signal) to the pump motor 280, and thus, the pump motor 280 may operate at a second output. Thus, water may be discharged from the water tank 200 by the second amount greater than the first amount per unit time.

When the adjusting part 710 is disposed at its center position, e.g., when both the first push part 711 and the second push part 712 are not pushed, a signal may not be applied to the pump motor 280 and the operation of the pump motor 280 may be stopped. Thus, the water may not be discharged from the water tank 200.

In some exemplary embodiments, a transmission member that transmits the pressing force of the first and second push parts 711 and 712 to the first and second elements 751 and 752 may be disposed on one side of the first and second push parts 711 and 712.

The transmission member may be disposed between the adjusting part 710 and the first and second elements 751 and 752 to rotate about the vertical rotation axis together with the adjusting part 710. Thus, when the first push part 711 is pushed by the user, the first element 751 may be pushed, and when the second push part 712 is pushed by the user, the second element 752 may be pushed.

Figure 6:
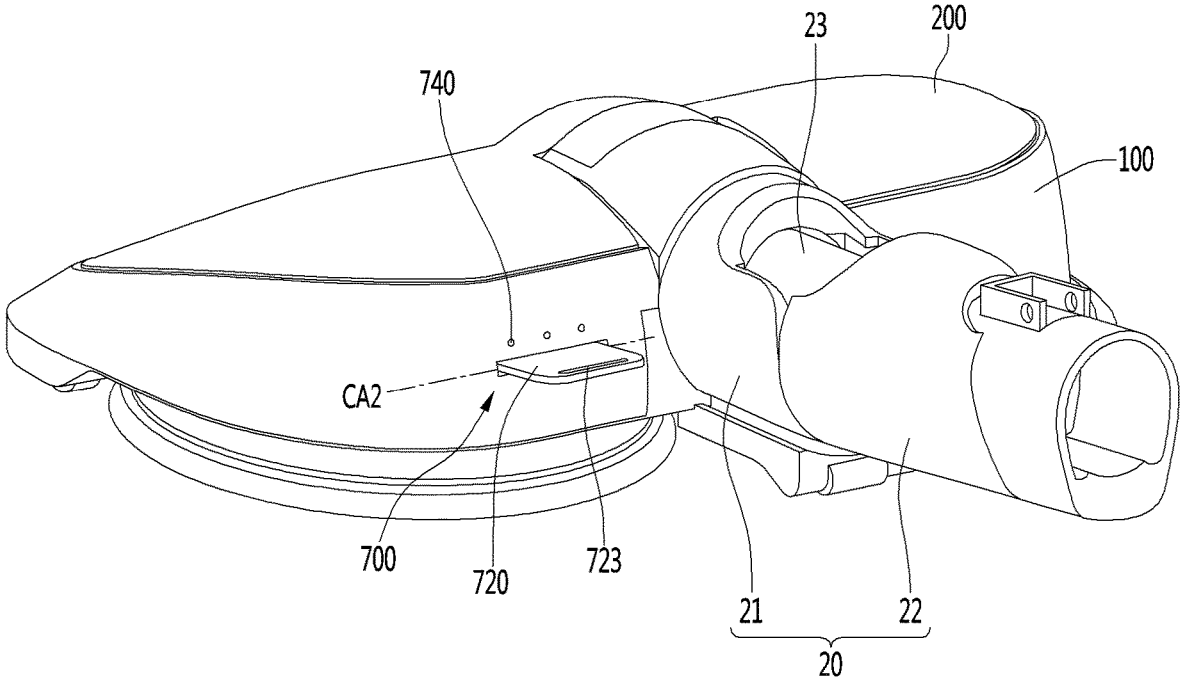
FIG. 6 is a perspective view illustrating an exemplary embodiment in which a water adjusting lever is mounted on a rear surface of the nozzle body when viewed from a rear side of the nozzle body.
Figure 7A:
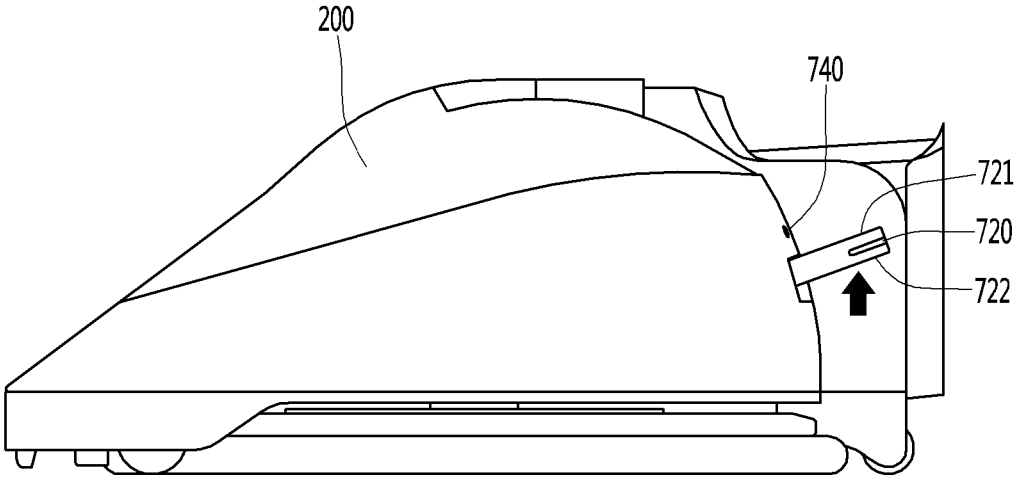
FIGS. 7A and 7B are views illustrating various manipulation states of the exemplary water adjusting lever of FIG. 6 when viewed from a side of the nozzle body.
Figure 7B:
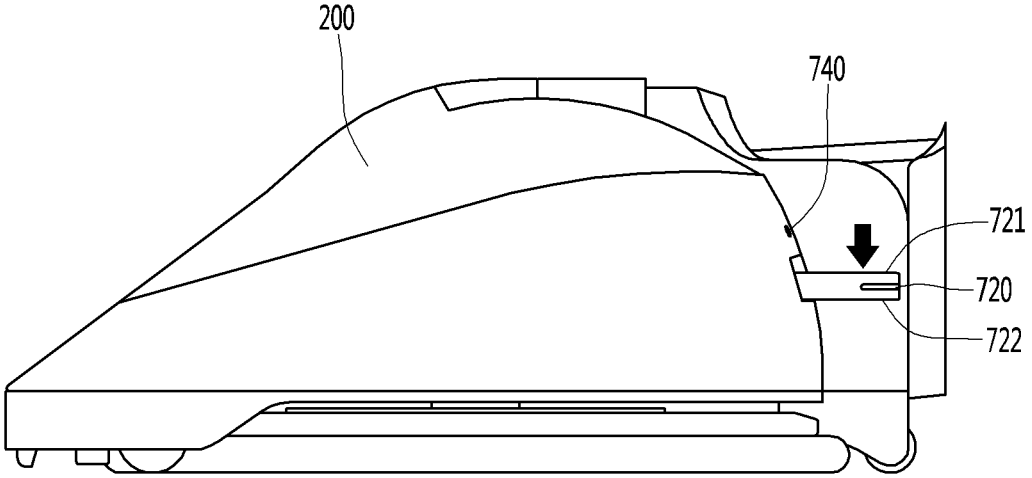
Figure 8:
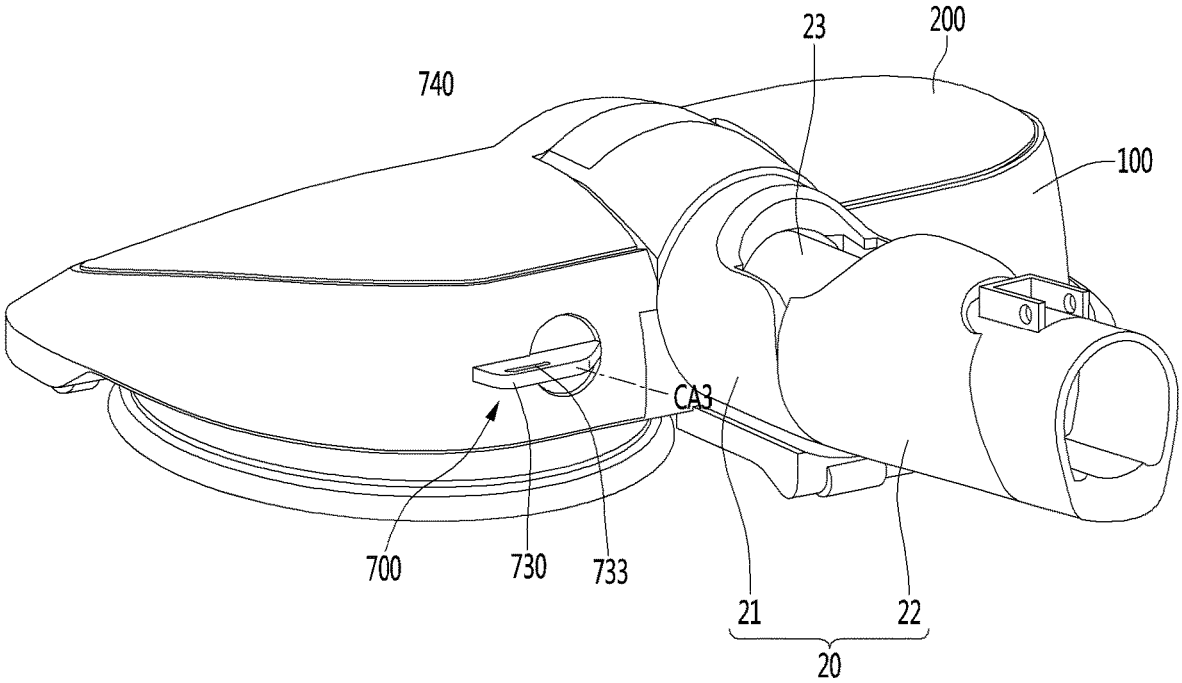
FIG. 8 is a perspective view illustrating a modified example in which the water adjusting lever is mounted on the rear surface of the nozzle body when viewed from the rear side of the nozzle body.
Figure 9A:
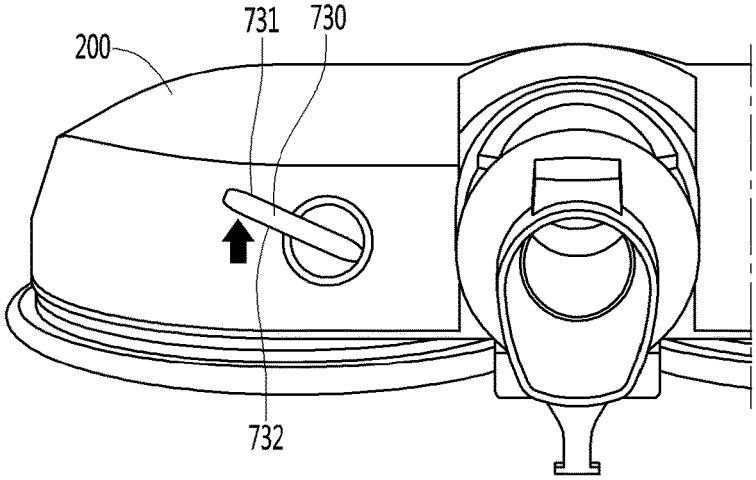
FIGS. 9A, 9B and 9C are views illustrating various manipulation states of the exemplary water adjusting lever of FIG. 8 when viewed from the rear side of the nozzle body.
Figure 9B:
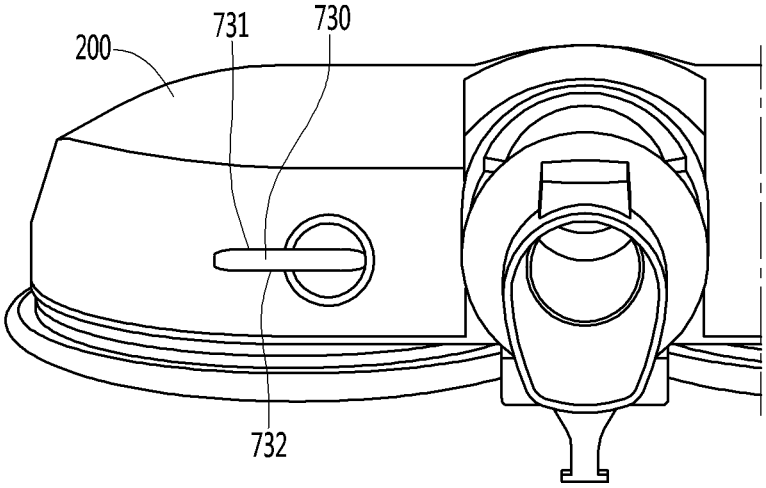
Figure 9C:
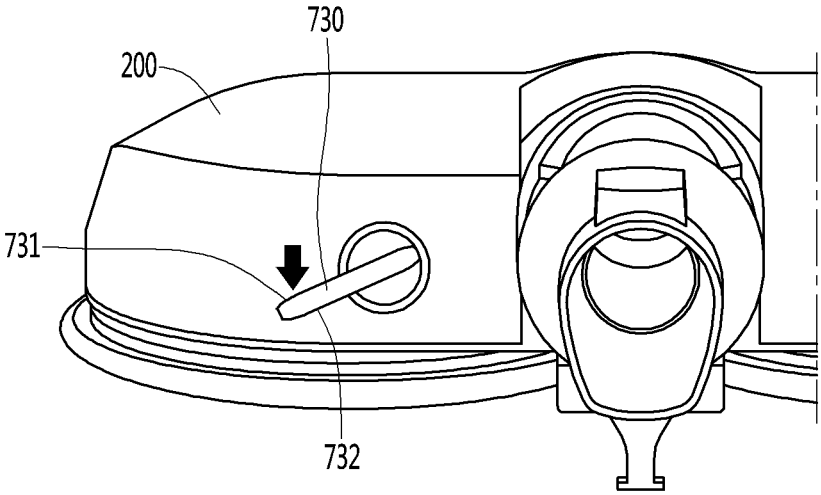

FIG. 6 is a perspective view illustrating a state in which a water adjusting lever is mounted on the rear surface of the nozzle body when viewed from a rear side of the nozzle body. Also, FIG. 7 is a view illustrating various manipulation states of the water adjusting lever of FIG. 6 when viewed from a side of the nozzle body. Also, FIG. 8 is a perspective view illustrating a modified example of the state in which the water adjusting lever is mounted on the rear surface of the nozzle body when viewed from the rear side of the nozzle body. Also, FIG. 9 is a view illustrating various manipulation states of the water adjusting lever of FIG. 8 when viewed from the rear side of the nozzle body.

<Water Adjusting Lever>

Referring to FIGS. 6 to 9, the water adjuster 700 may include the adjusting part 720 and the adjusting part 730 disposed outside the rear side of the nozzle body 10 to receive a pressing force that is vertically applied through the user's hand or foot. The adjusting part 720 and the adjusting part 730 may each include a water adjusting lever.

As described above, when the adjusting part 720 receives the pressing force in the vertical direction, the user may easily manipulate the adjusting part 720 by using his/her hand or foot. In detail, the user may manipulate the adjusting part 720 in an exemplary manner in which the user pushes the adjusting part 720, which protrudes backward, downward or lift the adjusting part 720 upward.

Here, water may or may not be discharged from the water tank 200 through the adjusting parts 720 and 730 based on the number of times the user pushes a switch.

Also, water may be discharged from the water tank 200 through the adjusting parts 720 and 730 by the first amount per unit time or the second amount greater than the first amount per unit time according to the number of times of pushing each of the adjusting parts 720 and 730 by the user.

For example, in the state in which the water is not discharged from the water tank 200, when the user pushes the adjusting parts 720 and 730 once at one time, the adjusting parts 720 and 730 may be configured so that water is discharged from the water tank 200 by the first amount per unit time, and when the user pushes the adjusting parts 720 and 730 twice at one time, the adjusting parts 720 and 730 may be configured so that water is discharged from the water tank 200 by the second amount greater than the first amount per unit time.

Also, when the user pushes the adjusting parts 720 and 730 three times at one time, water may not be discharged from the water tank 200.

The pump motor 280 may operate in a first mode in a state in which the adjusting parts 720 and 730 are pressed downward to descend. The pump motor 280 may operate in a second mode different from the first mode in a state in which the adjusting parts 720 and 730 are lifted upward to ascend.

Furthermore, in the state in which the adjusting parts 720 and 730 are disposed at their center positions, the pump motor 280 may operate in a third mode different from the first mode and the second mode.

Here, each of the first mode, the second mode, and the third mode may be any one of the state in which the pump motor 280 is stopped, a state in which the pump motor 280 rotates at the first speed, and a state in which the pump motor rotates at the second speed.

For example, the adjusting part 720 may vertically rotate about the horizontal central axis CA2 as illustrated in FIG. 6. Here, the central axis CA2 may be horizontally or inclinedly defined. That is, in some exemplary embodiments, the central axis CA2 may be inclined relative to the horizontal direction. Also, the adjusting part 720 may rotate in units of about 10 degrees to 30 degrees about the central axis CA2.

As described above, when the adjusting part 720 is provided, the user may simply push the adjusting part 720 downward or lift the adjusting part 720 upward by using his/her hand or foot so that water is discharged from the water tank 200 or is not discharged from the water tank 200.

Also, water may be discharged from the water tank 200 by the first amount per unit time or discharged by the second amount greater than the first amount per unit time.

In detail, as illustrated in FIG. 7(*a*), in the state in which the adjusting part 720 maximally ascends, the pump motor 280 may be turned off. That is, in the state in which the adjusting part 720 maximally ascends as illustrated in FIG. 7(*a*), water may not be discharged from the water tank 200.

On the other hand, in the state in which the adjusting part 720 maximally descends, the pump motor 280 may rotate the second rotation speed (rpm).

For reference, in the state in which the adjusting part 720 is disposed at its center position, the pump motor 280 may rotate the first rotation speed (rpm) less than the second rotation speed.

That is, as illustrated in FIG. 7(*b*), when the user pushes the adjusting part 720 so that it maximally descends, water may be discharged from the water tank 200 by the second amount per time unit. Also, when the user locates the adjusting part 720 at a center between a position of FIG. 7(*a*) and a position of FIG. 7(*b*), water may be discharged from the water tank 200 by the first amount per unit time less than the second amount per unit time.

On the other hand, as illustrated in FIG. 7(*a*), in the state in which the adjusting part 720 maximally ascends, the pump motor 280 may rotate at the first rotation speed (rpm) or the second rotation speed (rpm).

Also, as illustrated in FIG. 7(*b*), in the state in which the adjusting part 720 maximally descends, the pump motor 280 may be turned off. Also, in the state in which the adjusting part 720 is disposed at the center between the position of FIG. 7(*a*) and the position of FIG. 7(*b*), the pump motor 280 may be turned off.

As another example, the adjusting part 730 may vertically rotate about the central axis CA3 in the front-rear direction as illustrated in FIG. 8. Here, the central axis CA3 may be horizontally or inclinedly defined. That is, the central axis CA3 may be aligned with a direction parallel to the floor. For example, the central axis CA3 may extend in the front-rear direction. Or, the central axis CA3 may be inclined relative to the front-rear direction, for example. Also, the adjusting part 730 may rotate in units of about 20 degrees to 25 degrees about the central axis CA3.

Here, the adjusting part 730 may extend outward from the inside that is closest to the central portion in the horizontal direction.

As described above, when the adjusting part 730 is provided, the user may cause the adjusting part 730 to simply rotate downward or upward by using his/her hand or foot so that water is discharged from the water tank 200 or is not discharged from the water tank 200.

Also, water may be discharged from the water tank 200 by the first amount per unit time or discharged by the second amount greater than the first amount per unit time.

In detail, as illustrated in FIG. 9(*a*), in the state in which the adjusting part 730 rotates upward by the user, the pump motor 280 may be turned off. As described above, when the pump motor 280 is turned off, water may not be discharged from the water tank 200.

Also, as illustrated in FIG. 9(*b*), when the adjusting part 730 is disposed at the central position while rotating downward by the user, the pump motor 280 may rotate at the first rotation speed (rpm). As described above, when the pump motor 280 rotates at the first rotation speed (rpm), water may be discharged from the water tank 200 by the first amount per unit time.

Also, as illustrated in FIG. 9(*b*), when the adjusting part 730 is disposed at the lower side while rotating downward by the user, the pump motor 280 may rotate at the second rotation speed (rpm) greater than the first rotation speed (rpm). As described above, when the pump motor 280 rotates at the second rotation speed (rpm), water may be discharged from the water tank 200 by the second amount greater than the first amount per unit time.

That is, in the state in which the adjusting part 730 is disposed at the upper side as illustrated in FIG. 9(*a*), water may not be discharged, and then, when the user allows the adjusting part 730 to rotate downward so that the adjusting part 730 is disposed at the central portion, water may be disposed from the water tank 200 by the first amount per unit time. Also, when the user causes the adjusting part 730 to rotate downward so that the adjusting part 730 is disposed at the lower side, water may be discharged from the water tank 200 by the second amount per unit time.

Also, the adjusting parts 720 and 730 may protrude downward, and top surfaces 721 and 731 and bottom surfaces 722 and 732 of the adjusting parts 720 and 730 may be flat to provide a plane.

As described above, when each of the adjusting parts 720 and 730 has a plate shape, the adjusting parts 720 and 730 may be easily manipulated by using the user's hand as well as the user's foot. In detail, the user may push the adjusting parts 720 and 730 or lift the adjusting parts 720 and 730 upward by using his/her big toe.

<Touch Manner of Interaction>

Also, each of the adjusting parts 710, 720, and 730 may include a touch button (not shown) provided outside the rear side of the nozzle body 10 so that a manipulation command is input in a touch manner through the user's hand or foot.

As described above, when the touch button is provided, the turning on/off of the pump motor 280 may be controlled through only simple manipulation in which the user's toe contacts the touch button so that the rotation speed of the pump motor 280 is adjusted.

In detail, in the state in which water is not discharged from the water tank 200, when the user pushes the touch button (not shown) once, water may be discharged from the water tank 200 by the first amount per unit time. Also, when the user pushes the touch button (not shown) twice, water may be discharged from the water tank 200 by the second amount greater than the first amount per unit time. Also, when the user pushes the touch button (not shown) three times, the operation of the pump motor 280 may be stopped to stop water discharge from the water tank 200.

<Display Part>

Also, the water adjuster 700 may include a display part 740 that emits light outward to the rear side of the nozzle body 10 to display various states of the pump motor 280 to the outside. The display part 740 may be differently displayed according to manipulation states of the adjusting parts 710, 720, and 730.

When the display part 740 is provided, the user may confirm the various states of the pump motor 280 through the user's naked eye.

For example, the display part 740 may include three lamps. Also, the three lamps may be disposed at the same intervals in a straight-line.

In this state, the first lamp may turn on while adjusting the adjusting parts 710, 720, and 730, and thus the user may confirm that the pump motor 280 rotates at the first rotation speed. That is, it is confirmed that water is discharged from the water tank 200 by the first amount per unit time.

Also, when the first and second lamps are turned on, the user may confirm that the pump motor 280 rotates at the second rotation speed greater than the first rotation speed. That is, it may be confirmed that water is discharged from the water tank 200 by the second amount greater than the first amount per unit time.

Also, when the third lamp is turned on, the user may confirm that the pump motor 280 rotates at the third rotation speed greater than the second rotation speed. That is, it may be confirmed that water is discharged from the water tank 200 by the third amount greater than the second amount per unit time.

Also, when all the three lamps are turned off, the user may have stopped the operation of the pump motor 280, and thus, it may be confirmed that water discharge from the water tank 200 is stopped.

Figure 11:
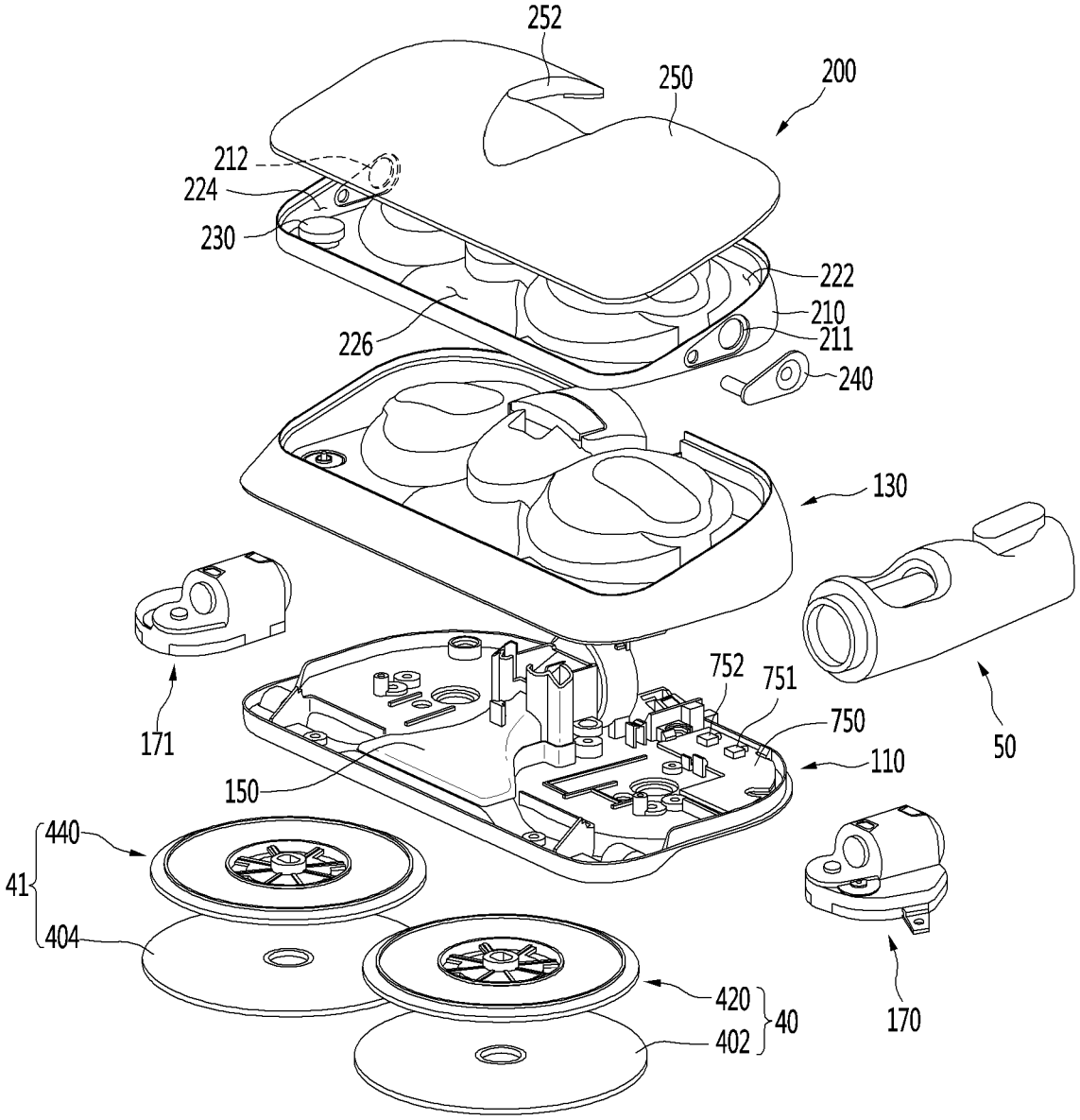
FIGS. 11 and 12 are exploded perspective views of a nozzle according to an exemplary embodiment.
Figure 12:
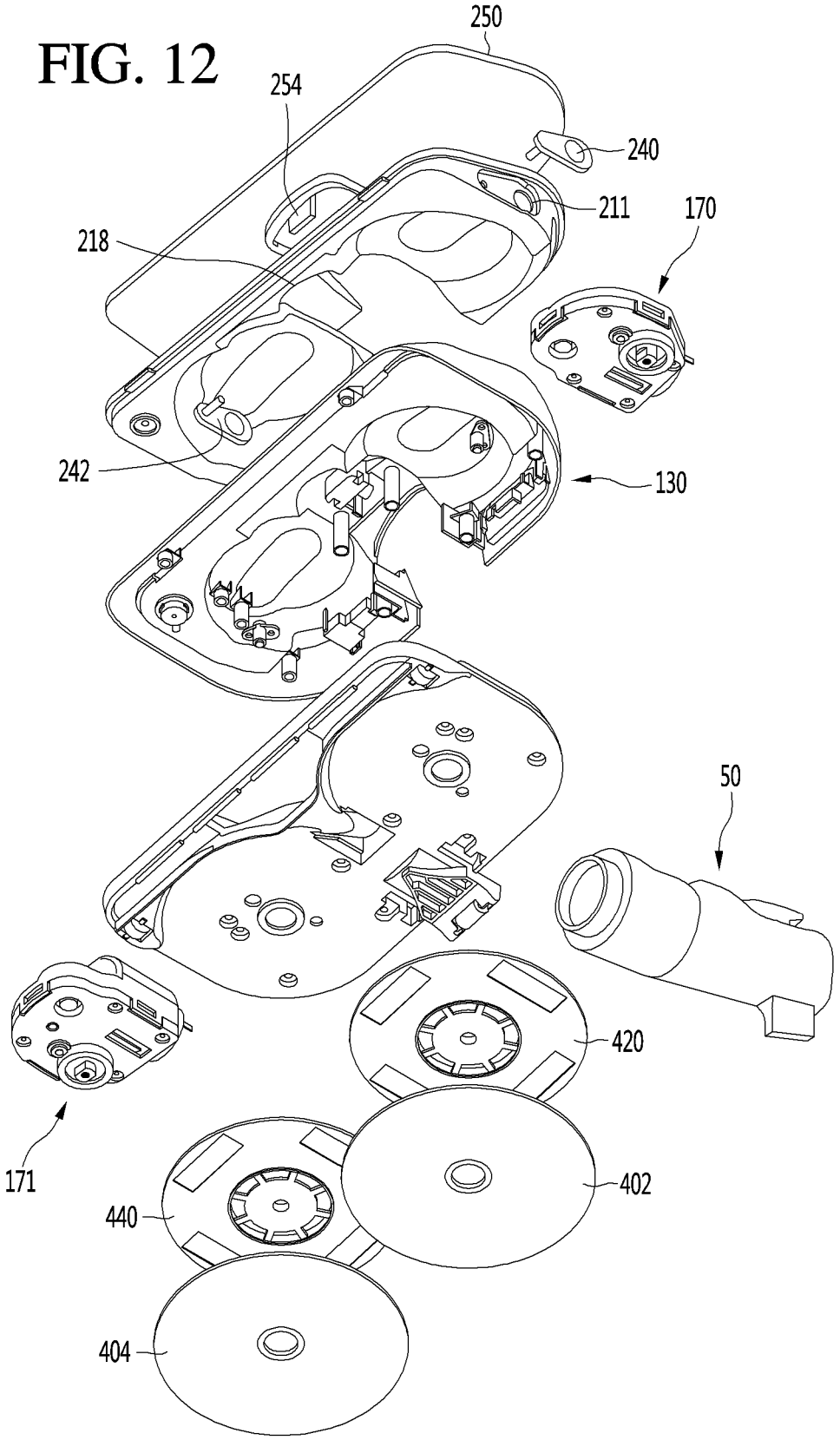
Figure 13:
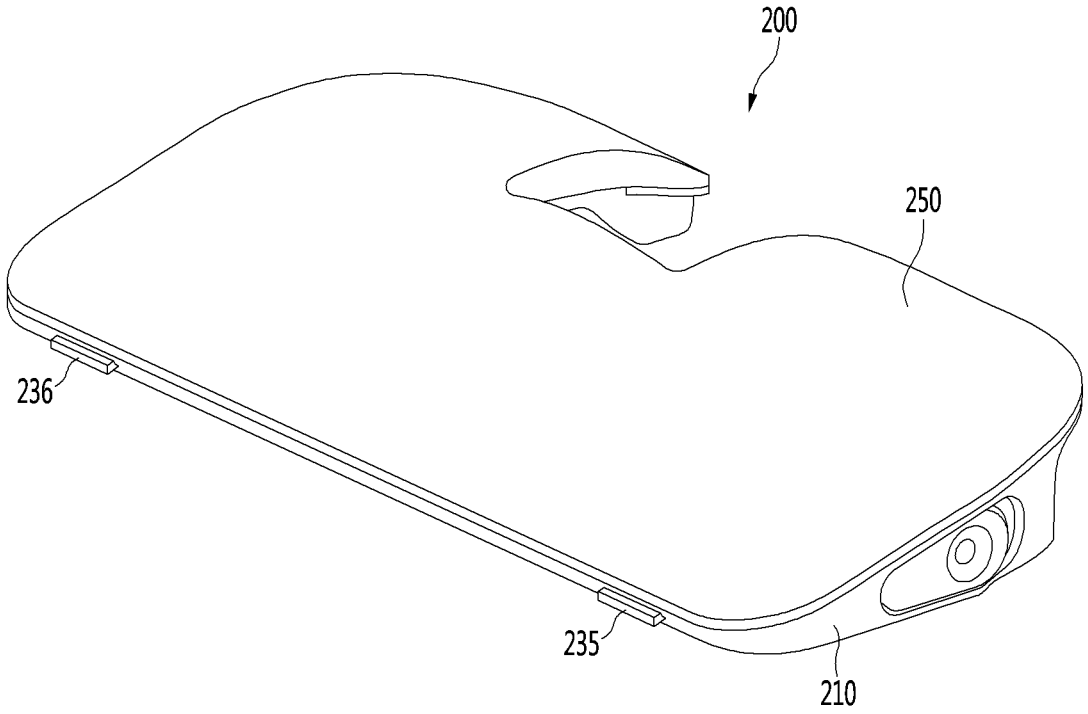
FIGS. 13 and 14 are perspective views of a water tank according to an exemplary embodiment.
Figure 14:
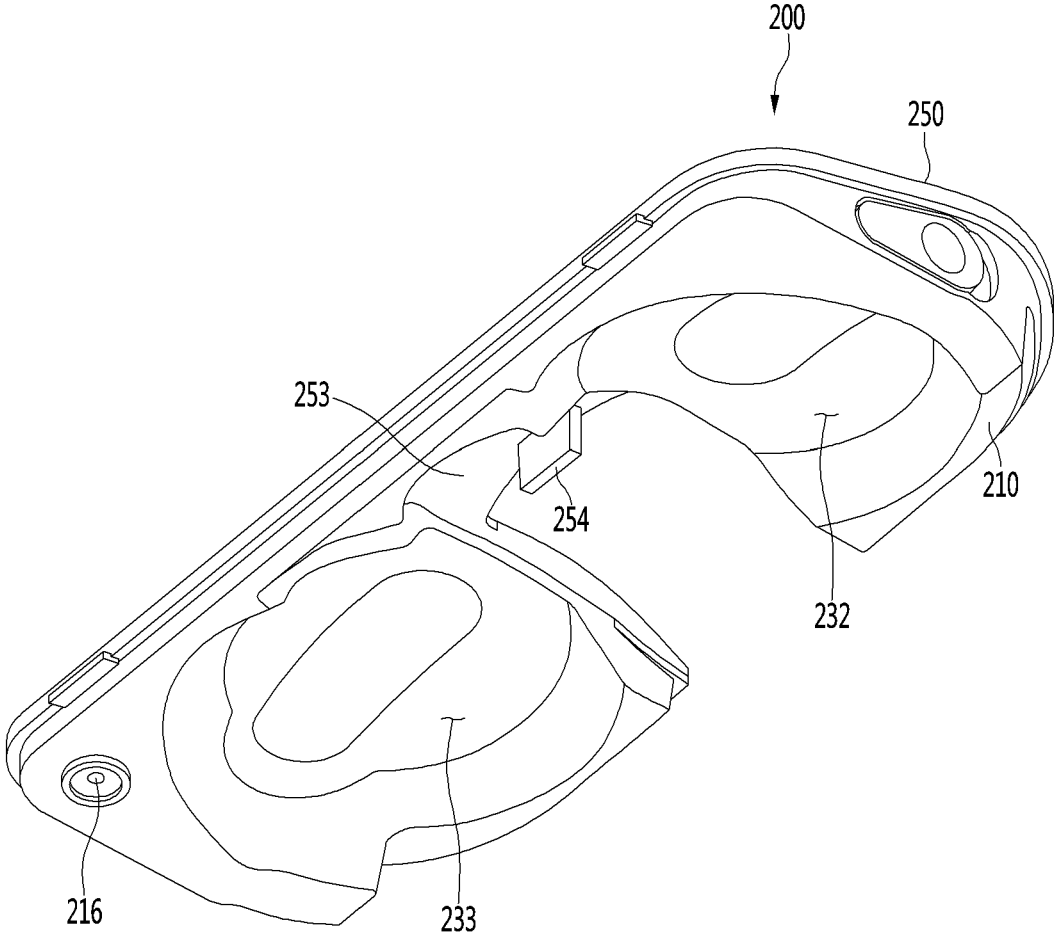

FIGS. 11 and 12 are exploded perspective views of the nozzle according to an exemplary embodiment, and FIGS. 13 and 14 are perspective views of the water tank according to an exemplary embodiment.

Referring to FIGS. 11, 12, 20, 21, and 25, the nozzle body 10 may further include a driver. For example, the nozzle body 10 may include a plurality of driving devices 170 and 171 for individually driving the rotation cleaning parts 40 and 41.

The plurality of driving devices 170 and 171 may include a first driving device 170 for driving the first rotation cleaning part 40 and a second driving device 171 for driving the second rotation cleaning part 41.

Since the driving devices 170 and 171 may be individually driven, even though one of the plurality of driving devices 170 and 171 may fail, the other driving device may be driven to allow a portion of the rotation cleaning parts 40 and 41 to rotate.

The first driving device 170 and the second driving device 171 may be arranged to be horizontally spaced apart from each other in the nozzle body 10.

Also, each of the driving devices 170 and 171 may be disposed behind the first passage 112.

For example, the second passage 114 may be disposed between the first driving device 170 and the second driving device 171. Thus, although a plurality of driving devices 170 and 171 may be provided, the second passage may not be affected by the first and second driving devices 170 and 171 and a length of the second passage 114 may be minimized.

According to the disclosed exemplary embodiment, since the first driving device 170 and the second driving device 171 are respectively disposed on both sides of the second passage 114, a weight of the nozzle 1 may be horizontally balanced to prevent a center of gravity from leaning to any one side.

The plurality of driving devices 170 and 171 may be disposed within the nozzle body 10. For example, the plurality of driving devices 170 and 171 may be seated on the nozzle base 110 and covered by the nozzle cover 130.

That is, the plurality of driving devices 170 and 171 may be disposed between the nozzle base 110 and the nozzle cover 130.

The rotation cleaning parts 40 and 41 may further include rotation plates 420 and 440 that receive power from the driving devices 170 and 171 to rotate, respectively.

The rotation plates 420 and 440 may include a first rotation plate 420 which may be connected to the first driving device 170 and to which the first rag 402 may be attached and a second rotation plate 440 which may be connected to the second driving device 171 and to which the second rag 404 may be attached.

Each of the rotation plates 420 and 440 may have a circular plate shape, and the rags 402 and 404 may be respectively attached to the rotation plates 420 and 440.

The rotation plates 420 and 440 may be connected to the driving devices 170 and 171 below the nozzle base 110, respectively. That is, the rotation plates 420 and 440 may be connected to the driving devices 170 and 171 outside the nozzle housing 100, respectively.

<Water Tank>

The water tank 200 may be mounted on the nozzle housing 100. For example, the water tank 200 may be seated on the nozzle cover 130. In the state in which the water tank 200 is seated on the nozzle cover 130, the water tank 200 may define a portion of the outer appearance of the nozzle body 10. For example, the water tank 200 may define a portion of an outer appearance of a top surface of the nozzle body 10.

The water tank 200 may include a first body 210 and a second body 250 coupled to the first body 210 to define a chamber, in which water is stored, together with the first body 210.

The chamber may include a first chamber 222 disposed above the first driving device 170, a second chamber 224 disposed above the second driving device 171, and a connection chamber 226 connecting the first chamber 222 to the second chamber 224 and disposed above the second passage 114.

In the disclosed exemplary embodiment, the connection chamber 226 may have a volume less than that of each of the first chamber 222 and the second chamber 224 so that an amount of water to be stored increases while minimizing an increase in height of the nozzle 1 by the water tank 200.

The water tank 200 may be disposed so that a front height thereof is low, and a rear height thereof is high. For example, the connection chamber 226 may connect the first chamber 222 and the second chamber 224, which are disposed on both sides at the front portion of the water tank 200, to each other. That is, the connection chamber 226 may be disposed at the front portion of the water tank 200.

The water tank 200 may include a first injection hole 211 through which water may be injected into the first chamber 222 and a second injection hole 212 through which water may be injected into the second chamber 224.

The first injection hole 211 may be covered by a first injection hole cover 240, and the second injection hole 212 may be covered by a second injection hole cover 242. For example, each of the injection hole covers 242 and 240 may be made of a rubber material.

Each of the injection holes 211 and 212 may be formed in, for example, the first body 210.

Both side surfaces of the first body 210 may have the highest height at a rear end thereof and the lowest height at a front end thereof.

To secure a size of each of the injection holes 211 and 212, each of the injection holes 211 and 212 may be disposed closer to the rear end than the front end in the first body 210.

The first body 210 may include a first slot 218 for preventing the manipulation part 300 and the coupling parts 310 and 254 from interfering with each other. The first slot 218 may have a shape in which a rear end of a central portion of the first body 210 is recessed forward.

Also, the second body 250 may include a second slot 252 for preventing an interference with the manipulation part 300. The second slot 252 may have a shape in which a rear end of a central portion of the second body 250 is recessed forward.

The second body 250 may further include a slot cover 253 covering a portion of the first slot 218 of the first body 210 in a state of being coupled to the first body 210. That is, the second slot 252 may have a length in the front-rear direction, which is less than that of the first slot 218 in the front-rear direction.

Also, the second coupling part 254 may extend downward from the slot cover 253. Thus, the second coupling part 254 may be disposed within a space defined by the first slot 218.

The water tank 200 may further include coupling ribs 235 and 236 configured to be coupled to the nozzle cover 130 before the second coupling part 254 of the water tank 200 may be coupled to the first coupling part 310.

The coupling ribs 235 and 236 may guide a coupling position of the water tank 200 on the nozzle cover 130 before the second coupling part 254 of the water tank 200 may be coupled to the first coupling part 310.

For example, the plurality of coupling ribs 235 and 236 may protrude from the first body 210 and may be disposed to be spaced apart from each other in the horizontal direction.

Although not limited, the plurality of coupling ribs 235 and 236 may protrude forward from the front surface of the first body 210 and may be spaced apart from each other in the horizontal direction.

Since the driving devices 170 and 171 are provided in the nozzle body 10, a portion of the nozzle body 10 may protrude upward from both sides of the second passage 114 by the driving devices 170 and 171.

The water tank 200 may have a pair of accommodation spaces 232 and 233 to prevent an interference with portions protruding from the nozzle body 10. For example, the pair of accommodation spaces 232 and 233 may be formed by recessing a portion of the first body 210 upward. The pair of accommodation spaces 232 and 233 may be divided into left and right parts by the first slot 218.

The water tank 200 may further include a discharge hole 216 through which water is discharged.

For example, the discharge hole 216 may be formed in a bottom surface of the first body 210. The discharge hole 216 may be opened and closed by a valve 230. The valve 230 may be disposed within the water tank 200.

In the disclosed exemplary embodiment, the discharge hole 216 may be formed in a lower portion of one chamber among the first chamber 222 and the second chamber 224. The water tank 200 may include a single discharge hole 216.

The water tank 200 may include a single discharge hole 216 for reducing the number of paths through which water may leak.

That is, since some components (a control substrate, a driving motor, and the like) that receive power to operate are provided in the nozzle 1, contact between such components and water should be completely prevented. To prevent the components from contacting water, leakage at the portions through which the water is discharged should be prevented.

Since a structure for preventing water from leaking may additionally be required as the number of discharge holes increases, the structure may become complicated. Also, even though the structure for preventing leakage may be provided, it may be difficult to completely prevent leakage.

Also, as the number of discharge holes (e.g., like the discharge hole 216) increases in the water tank 200, the number of valves (e.g., like the valve 230) for opening and closing the discharge holes may increase. This may represent that the number of components increases as well as that the volume of the chamber for storing water within the water tank 200 is reduced.

Since the front side of the water tank 200 may be lower than the rear side of the water tank 200, the discharge hole 216 may be disposed close to the front end of the first body 210 so that the water within the water tank 200 is smoothly discharged.

<Nozzle Cover>

Figure 15:
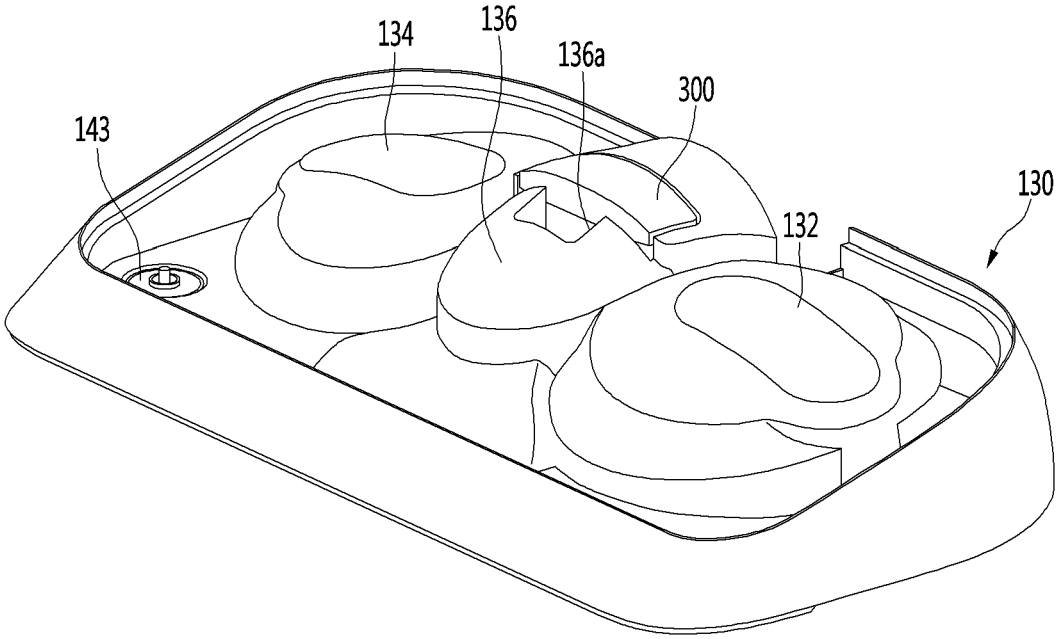
FIG. 15 is a perspective view of a nozzle cover when viewed from the upper side according to an exemplary embodiment.
Figure 16:
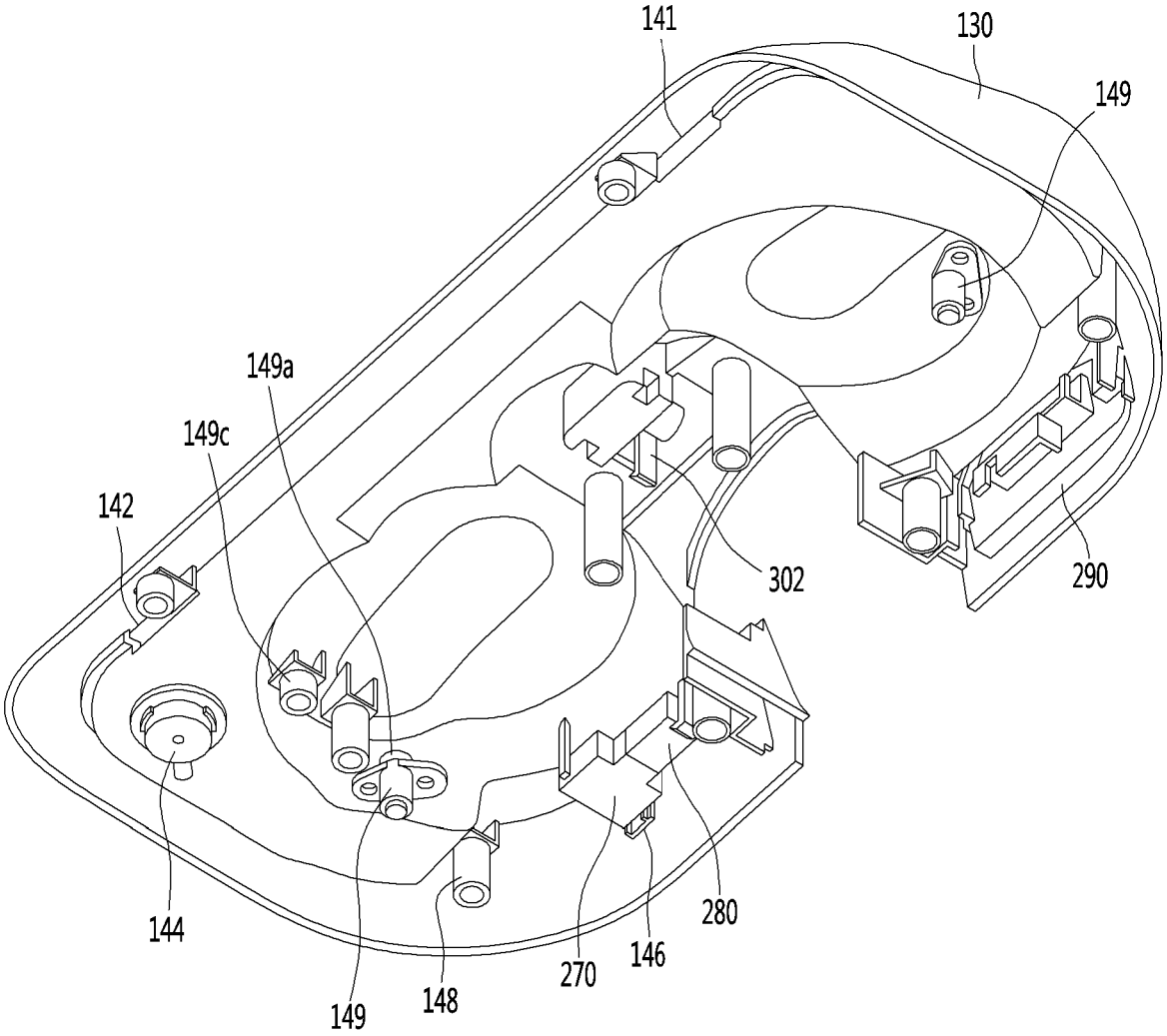
FIG. 16 is a perspective view of a nozzle cover when viewed from a lower side according to an exemplary embodiment.

FIG. 15 is a perspective view of the nozzle cover 130 when viewed from the upper side according to an exemplary embodiment, and FIG. 16 is a perspective view of the nozzle cover 130 when viewed from the lower side according to an exemplary embodiment.

Referring to FIGS. 11, 15, and 16, the nozzle cover 130 may include driving part covers 132 and 134 that cover upper sides of the driving devices 170 and 171.

Each of the driving part covers 132 and 134 may be a portion that protrudes upward from the nozzle cover 130. Each of the driving part covers 132 and 134 may surround an upper side of each of the driving devices 170 and 171 without interfering with each of the driving devices 170 and 171 installed on the nozzle base 110.

Also, when the water tank 200 is mounted on the nozzle cover 130, the driving part covers 132 and 134 may be respectively received into the accommodation spaces 232 and 233 to prevent components from interfering with each other.

Also, in the water tank 200, the first chamber 222 and the second chamber 224 may be disposed to surround circumferences of the driving part covers 132 and 134, respectively.

Thus, according to the disclosed exemplary embodiment, each of the first chamber 222 and the second chamber 224 may increase in volume.

The first body 210 of the water tank 200 may be seated on a portion of the nozzle cover 130, which is lower than the driving part covers 132 and 134.

At least a portion of the bottom surface of the water tank 200 may be disposed lower than axial lines A3 and A4 of the driving motor that will be described later. For example, the bottom surfaces of the first chamber 222 and the second chamber 224 may be disposed lower than the axial lines A3 and A4 of the driving motor that will be described later.

The nozzle cover 130 may further include a passage cover 136 covering the passage formation part 150. The passage cover 136 may be disposed between the driving part covers 132 and 134 and disposed at a position corresponding to the first slot 218 of the water tank 200.

Also, the passage cover 136 may support the manipulation part 300. The manipulation part 300 may include a coupling hook 302 coupled to the passage cover 136. The manipulation part 300 may be disposed above the passage cover 136 so as to be coupled to the passage cover 136.

The coupling hook 302 may prevent the manipulation part 300 from being separated upward from the passage cover 136 in the state of being coupled to the passage cover 136.

Also, an opening **136*a* into which the second coupling part 254 may be inserted may be formed in the passage cover 136. Also, while the second coupling part 254 of the water tank 200 may be inserted into the opening 136*a*, the first coupling part 310 may be coupled to the second coupling part 254**.

The passage cover 136 may be disposed on the first slot 218 of the first body 210 and the second slot 252 of the second body 250. In the disclosed exemplary embodiment, to allow the water tank 200 to increase in capacity, a portion of the water tank 200 may be disposed at each of both sides of the passage cover 136. Thus, the water tank 200 may increase in capacity while preventing the water tank 200 from interfering with the second passage 114.

Also, to prevent the water tank from increasing in height, a maximum height of the water tank 200 may be equal to or lower than a maximum height of the passage cover 136.

Also, to prevent the water tank 200 from colliding with peripheral structures of the nozzle 1 while the nozzle 1 moves, the entire water tank 200 may be disposed to vertically overlap the nozzle housing 100. That is, the water tank 200 may not protrude from the nozzle housing 100 in the horizontal direction and the front-rear direction.

The nozzle cover 130 may further include rib insertion holes 141 and 142 into which the coupling ribs 235 and 236 provided on the water tank 200 may be inserted.

Thus, in the state in which the coupling ribs 235 and 236 may be inserted into the rib insertion holes 141 and 142, a central portion of the water tank 200 may move downward to allow the second coupling part 254 to engage the first coupling part 310.

A valve manipulation part 144 which may drive the valve 230 within the water tank 200 and through which water flows may be coupled to the nozzle cover 130. The valve manipulation part 144 may be coupled to a lower portion of the nozzle cover 130, and a portion of the valve manipulation part 144 may pass through the nozzle cover 130 to protrude upward. The valve manipulation part 144 protruding upward may pass through the discharge hole 216 of the water tank 200 and then be inserted into the water tank 200 when the water tank 200 is mounted on the nozzle housing 100.

The valve manipulation part 144 will be described later.

A seal 143 for preventing water discharged from the water tank from leaking in the vicinity of the valve manipulation part 144 may be disposed on the nozzle cover 130. The seal 143 may include a gasket.

A pump, such as a water pump 270 for controlling the discharge of water from the water tank 200 may be installed on the nozzle cover 130. The water pump 270 may be connected to the pump motor 280. The water pump 270 may be configured to generate a flow while pump motor 280 is rotating.

A pump installation rib 146 for the installation of the water pump 270 may be provided below the nozzle cover 130.

The water pump 270 may be a pump that operates so that an inner valve body is expanded or contracted to allow an inlet and an outlet to communicate with each other while the inner valve body operates. The water pump 270 may be realized by a known structure, and thus, its detailed description will be omitted.

The valve body within the water pump 270 may be driven by the pump motor 280. Thus, according to the disclosed exemplary embodiment, while the pump motor 280 operates, the water of the water tank 200 may be continuously and stably supplied to the rotation cleaning parts 40 and 41.

The operation of the pump motor 280 may be controlled by manipulating the adjusting parts 710, 720, and 730. For example, the turning on/off of the pump motor 280 may be toggled by the adjusting parts 710, 720, and 730.

Alternatively, an output (or a rotation speed) of the pump motor 280 may be adjusted by the adjusting parts 710, 720, and 730.

A support part 290 for movably supporting the adjusting parts 710, 720, and 730 may be installed on the nozzle cover 130, and a variable resistor 292 or one or more switches may be connected to the adjusting parts 710, 720, and 730. A signal for controlling the pump motor 280 may vary based on a variation in resistance due to movement of the variable resistor 292, or a signal for controlling the pump motor 280 may vary by switching signals of one or more switches.

The nozzle cover 130 may further include one or more coupling bosses coupled to the nozzle base 110.

Also, an injection nozzle 149 for injecting water into the rotation cleaning parts 40 and 41 may be installed on the nozzle cover 130. For example, a plurality of injection nozzles 149 may be installed on the nozzle cover 130 in a state of being spaced apart from each other in the horizontal direction.

A nozzle installation boss 149*c* for the installation of the injection nozzle 149 may be disposed on the nozzle cover 130. For example, the injection nozzle 149 may be coupled to the nozzle installation boss 149*c* by a screw.

The injection nozzle 149 may include a connection part 149*a* to which a branch tube that will be described later is connected.

<Nozzle Base>

Figure 17:
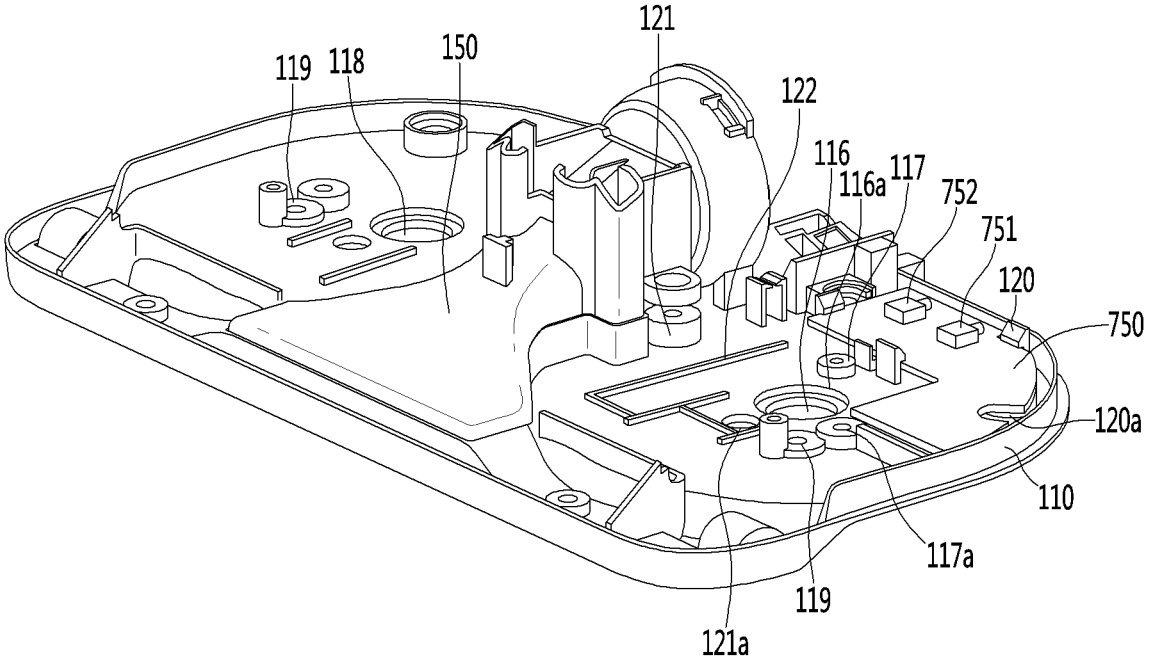
FIG. 17 is a view illustrating a state in which a passage formation part is coupled to a nozzle base according to an exemplary embodiment.
Figure 18:
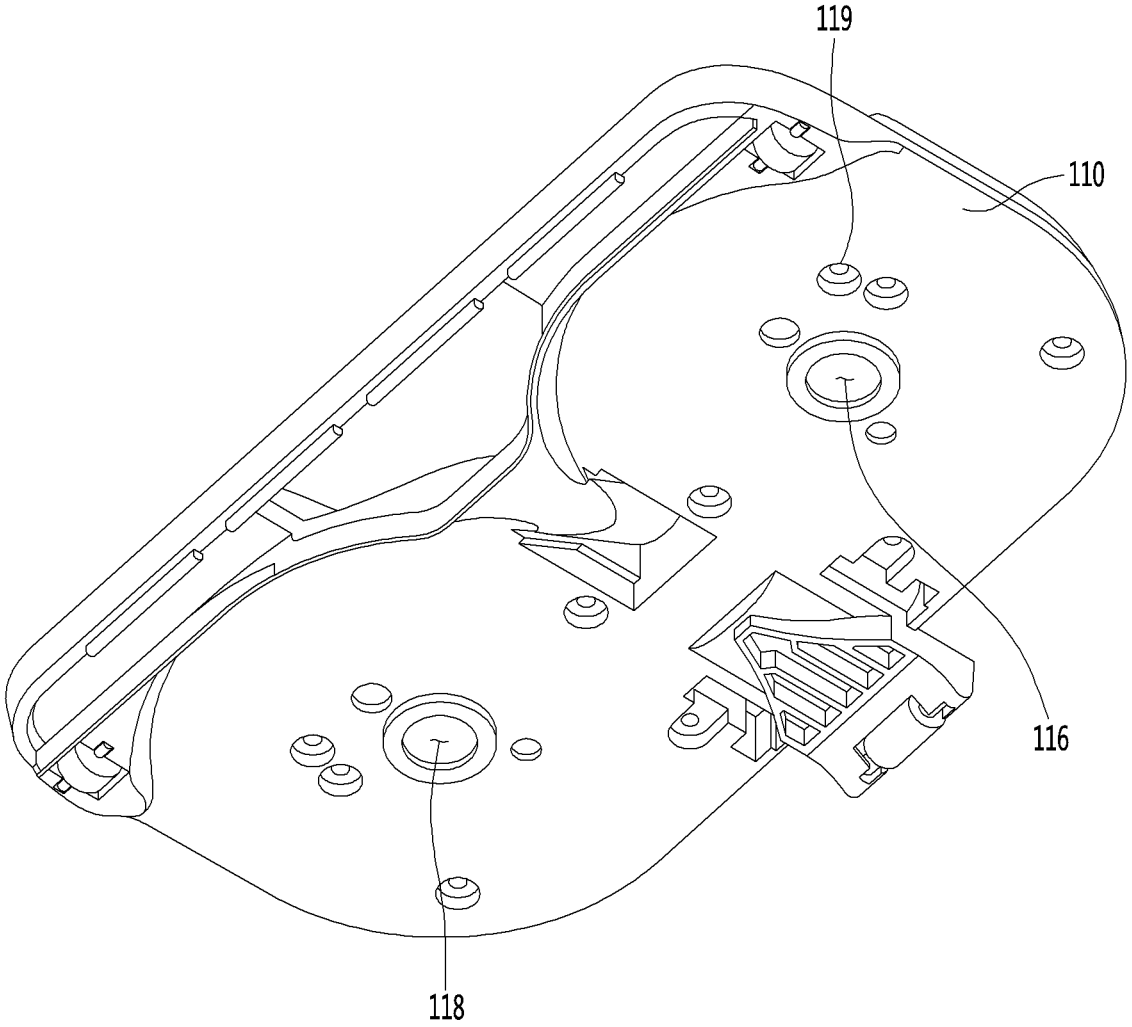
FIG. 18 is a view of a nozzle base when viewed from the lower side according to an exemplary embodiment.

FIG. 17 is a view illustrating a state in which the passage formation part 150 is coupled to the nozzle base 110 according to an exemplary embodiment, and FIG. 18 is a view of the nozzle base 110 when viewed from the lower side according to an exemplary embodiment.

Referring to FIGS. 11, 17, and 18, the nozzle base 110 may include a pair of shaft through-holes 116 and 118, through which transmission shafts (that will be described later) connected to the rotation plates 420 and 440 pass, which may interact with the driving devices 170 and 171.

For example, a seating groove 116*a* on which a sleeve (that will be described later) formed on each of the driving devices 170 and 171 is seated may be formed in the nozzle base 110, and the shaft through-holes 116 and 118 may be formed in the seating groove 116*a*.

For example, the seating groove 116*a* may have a circular shape and may be defined downward from the nozzle base 110. Also, the shaft through-holes 116 and 118 may be formed in the bottom surface of the seating groove 116*a*.

Since the sleeve (that will be described later) provided on each of the driving devices 170 and 171 may be seated on the seating groove 116*a*, the horizontal movement of the driving devices 170 and 171 may be limited while the nozzle 1 moves, or while the driving devices 170 and 171 operate.

In the state in which the passage formation part 150 is coupled to the nozzle base 110, the shaft through-holes 116 and 118 may be formed in both sides of the passage formation part 150, respectively.

A substrate installation part 120 on which a control substrate 750 for controlling each of the driving devices 170 and 171 and/or the pump motor is installed may be disposed on the nozzle base 110.

The control substrate 750 may be placed horizontally in the state in which the control substrate 750 is disposed on the substrate installation part 120. Also, the control substrate 750 may be installed to be spaced apart from the bottom surface of the nozzle base 110.

An effect of the above may be that water may be prevented from contacting the control substrate 750 even though water may leak to the bottom surface of the nozzle base 110. For this, a support protrusion 120*a* supporting the control substrate 750 to be spaced apart from the bottom surface may be disposed on the nozzle base 110.

Although not limited, the substrate installation part 120 may be disposed at one side of the passage formation part 150 on the nozzle base 110. For example, the control substrate 750 may be disposed at a position close to the adjusting parts 710, 720, and 730.

Thus, a structure for connecting the control substrate 750 to the variable resistor 292 or the switch may be simplified.

In the disclosed exemplary embodiment, the control substrate 750 may be disposed at an opposite side of the valve manipulation part 144 with respect to the second passage 114. This may be for preventing water from flowing to the control substrate 750 even though water may leak through the valve manipulation part 144.

The nozzle base 110 may further include a support rib 122 supporting a lower portion of each of the driving devices 170 and 171 and coupling bosses 117 and 117*a* coupled to the driving devices 170 and 171.

The support rib 122 may protrude from the nozzle base 110 and be bent at least once to space each of the driving devices 170 and 171 apart from the bottom surface of the nozzle base 110. Alternatively, a plurality of support ribs 122 spaced apart from each other may protrude from the nozzle base 110 to space each of the driving devices 170 and 171 apart from the bottom surface of the nozzle base 110.

Even though water may drop down to the bottom surface of the nozzle base 110, since the driving devices 170 and 171 are spaced apart from the bottom surface of the nozzle base 110 by the support rib 122, the flow of the water toward the driving devices 170 and 171 may be minimized.

Also, the nozzle base 110 may further include a nozzle hole 119 through which each of the injection nozzles 149 passes.

A portion of the injection nozzle 149 coupled to the nozzle cover 130 may pass through the nozzle hole 119 when the nozzle cover 130 is coupled to the nozzle base 110.

Also, the nozzle base 110 may further include an avoidance hole 121*a* for preventing an interference with the structures of each of the driving devices 170 and 171 and a coupling boss 121 coupled to the passage formation part 150.

Since a portion of each of the driving devices 170 and 171 is disposed in the avoidance hole 121*a*, the support rib 122 may be disposed around the avoidance hole 121*a* so that the flow of water toward the avoidance hole 121*a* is minimized. For example, the avoidance hole 121*a* may be formed within a region in which the support rib 122 is formed.

Figure 19:
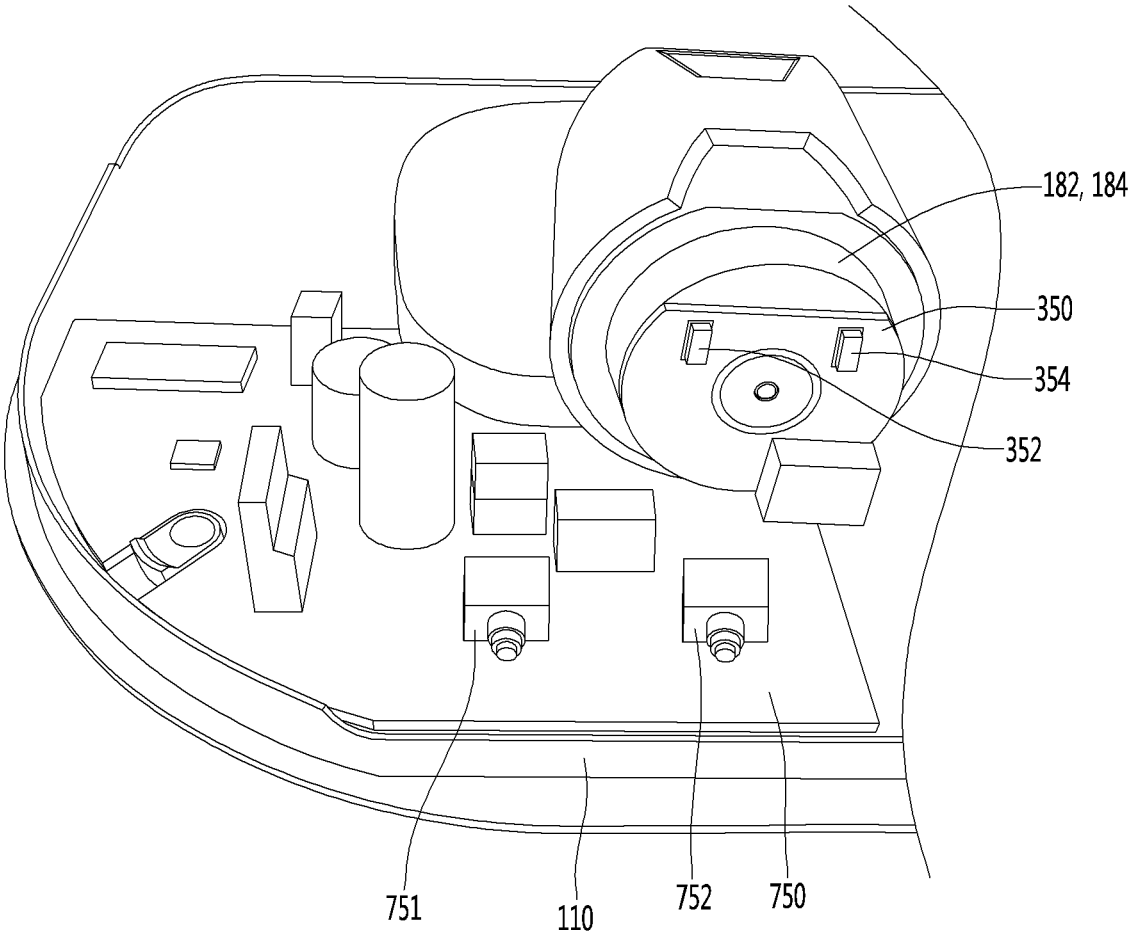
FIG. 19 is a view of a plurality of switches installed on a control substrate according to an exemplary embodiment.

FIG. 19 is a view of a plurality of switches installed on the control substrate 750 according to an exemplary embodiment.

Referring to FIGS. 17 and 19, the above-described control substrate 750 may be installed on the nozzle base 110. A plurality of elements (e.g., a first element 751 and a second element 752), each of which has a switch shape for detecting the manipulation of the adjusting parts 710, 720, and 730 may be installed on a top surface of the control substrate 750.

The plurality of elements may be installed to be spaced apart from each other in the horizontal direction.

The plurality of elements may include a first element 751 that detects a first position of each of the adjusting parts 710, 720, and 730 and a second element 752 that detects a second position of each of the adjusting parts 710, 720, and 730.

For example, when each of the adjusting parts 710, 720, and 730 is pivoted to one side to move to the first position, each of the adjusting parts 710, 720, and 730 may press a contact point of the first element 751 to turn the first element 751 on. In this case, the pump motor 280 may operate at a first output to discharge water from the water tank 200 by the first amount per unit time.

When each of the adjusting parts 710, 720, and 730 is pivoted to the other side to move to the second position, each of the adjusting parts 710, 720, and 730 may press a contact point of the second element 752 to turn the second element 752 on.

In this case, the pump motor 280 may operate at a second output greater than the first output to discharge water from the water tank 200 by the second amount per unit time.

Also, when each of the adjusting parts 710, 720, and 730 is disposed at an intermediate position between the first position and the second position (e.g., a center position), each of the adjusting parts 710, 720, and 730 may not press the contact point of the first and second elements 751 and 752 to stop an operation of the pump motor 280.

<Driving Device>

Figure 20:
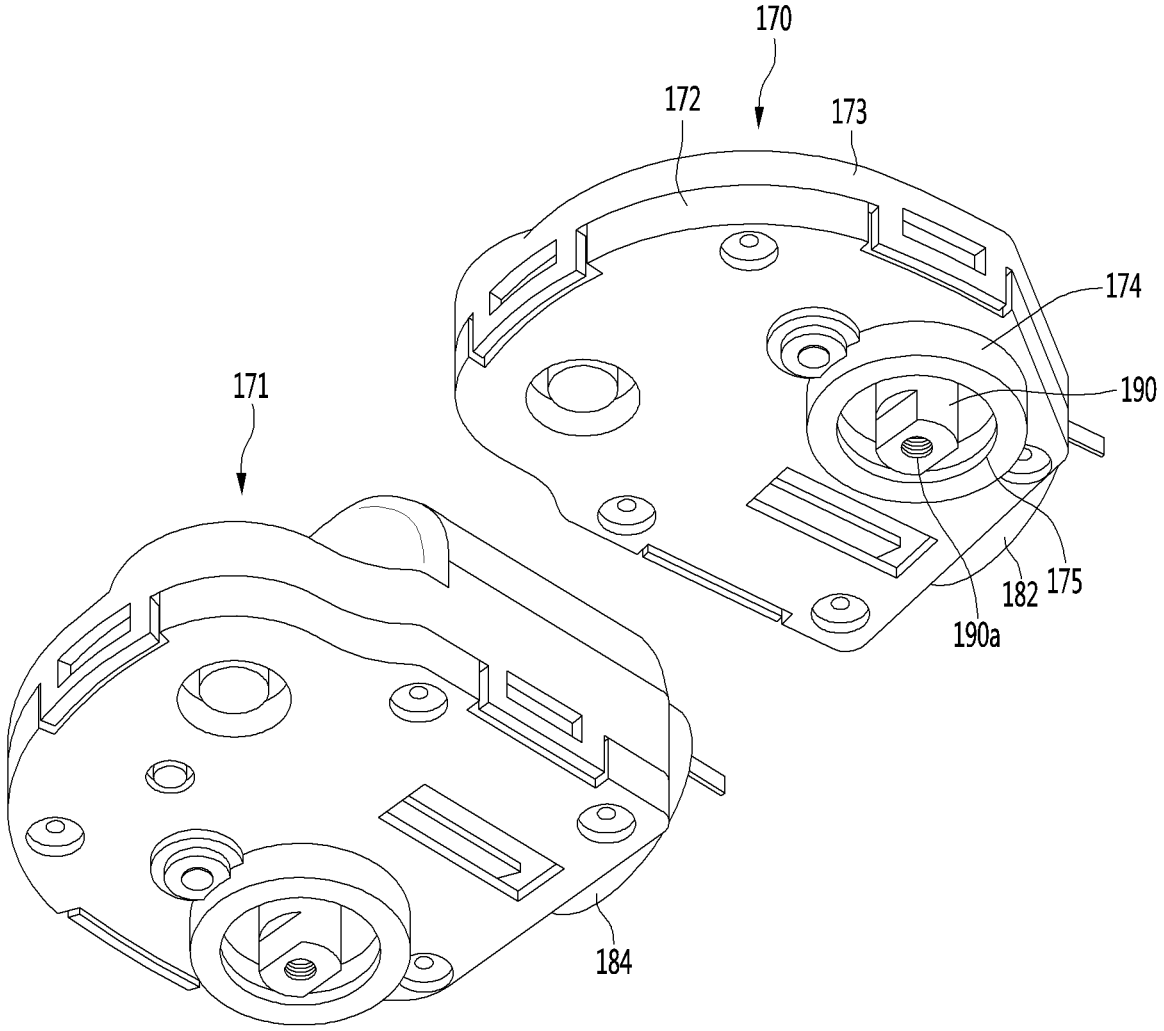
FIG. 20 is a view of first and second driving devices when viewed from the lower side according to an exemplary embodiment.
Figure 21:
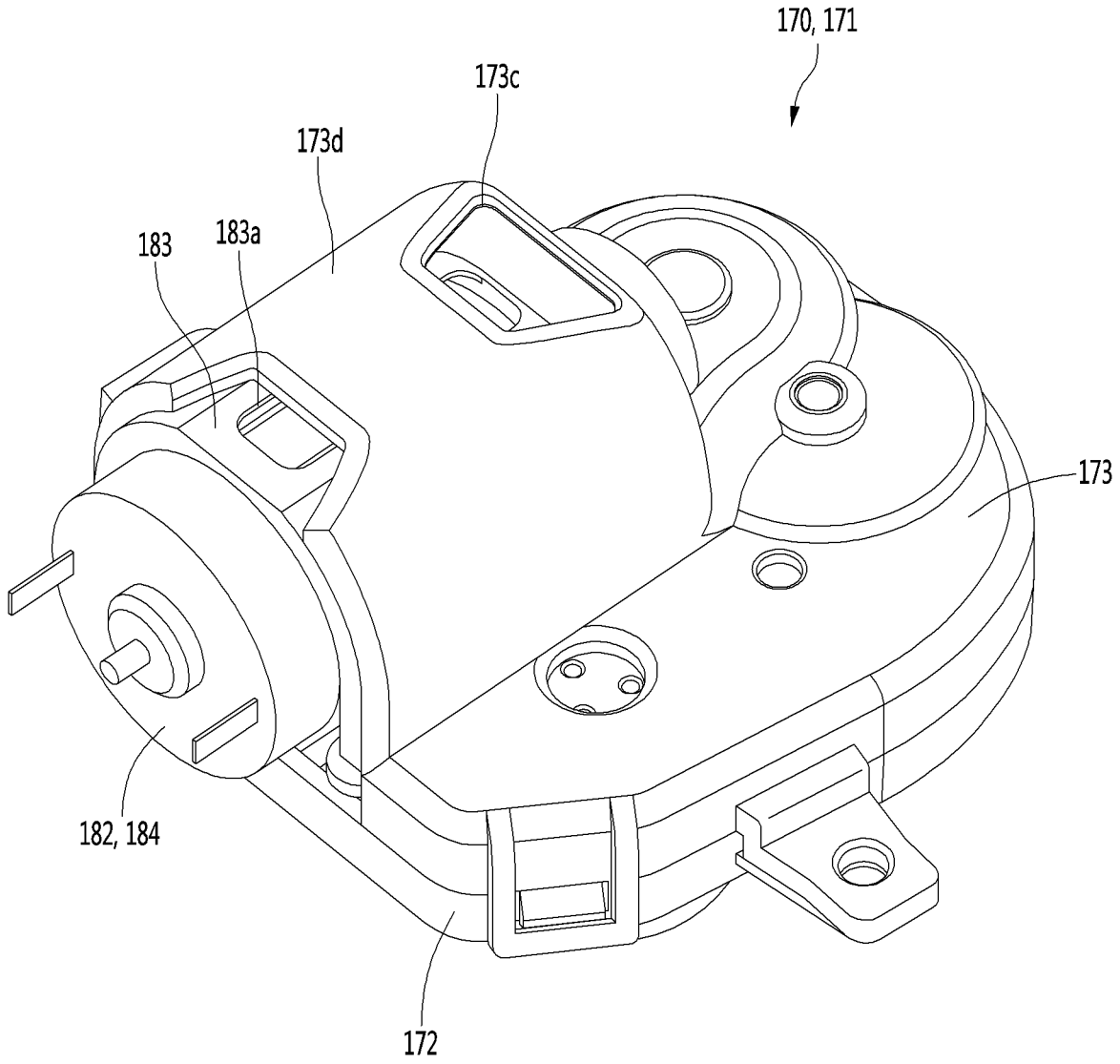
FIG. 21 is a view of first and second driving devices when viewed from the upper side according to an exemplary embodiment.
Figure 22:
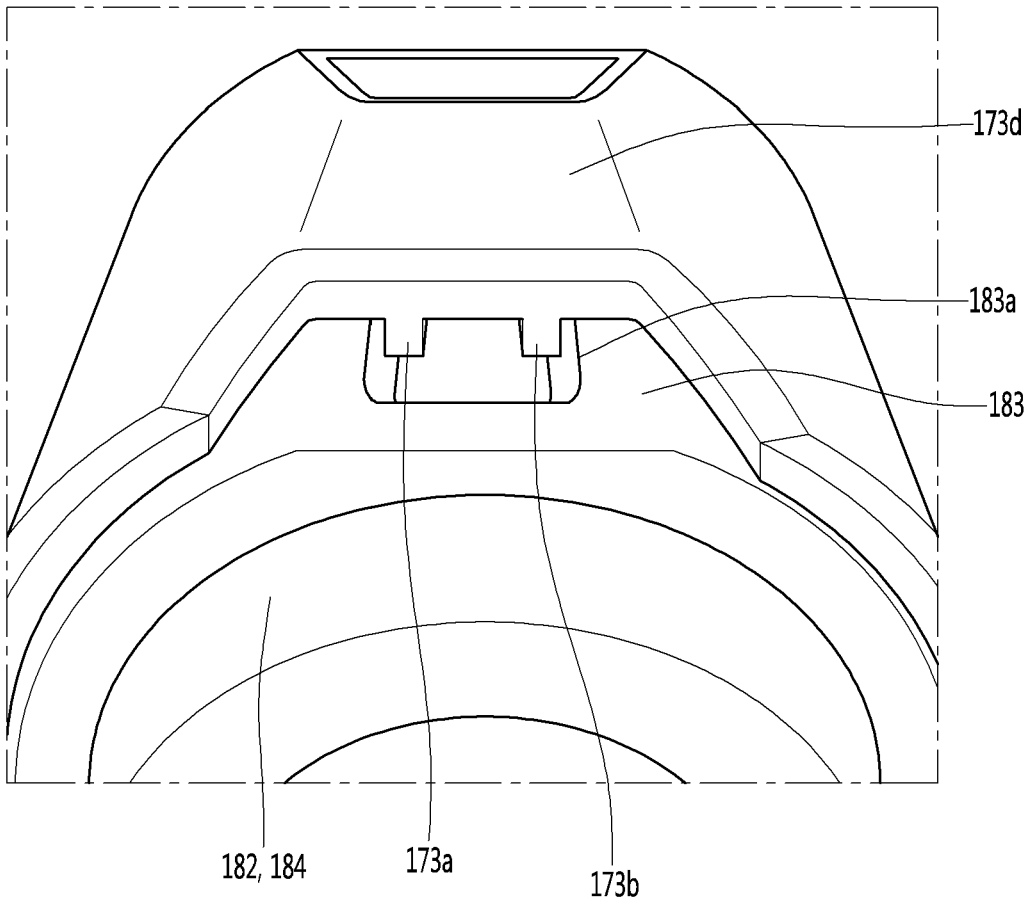
FIG. 22 is a view illustrating an exemplary motor housing and a structure for preventing a driving motor from rotating.
Figure 23:
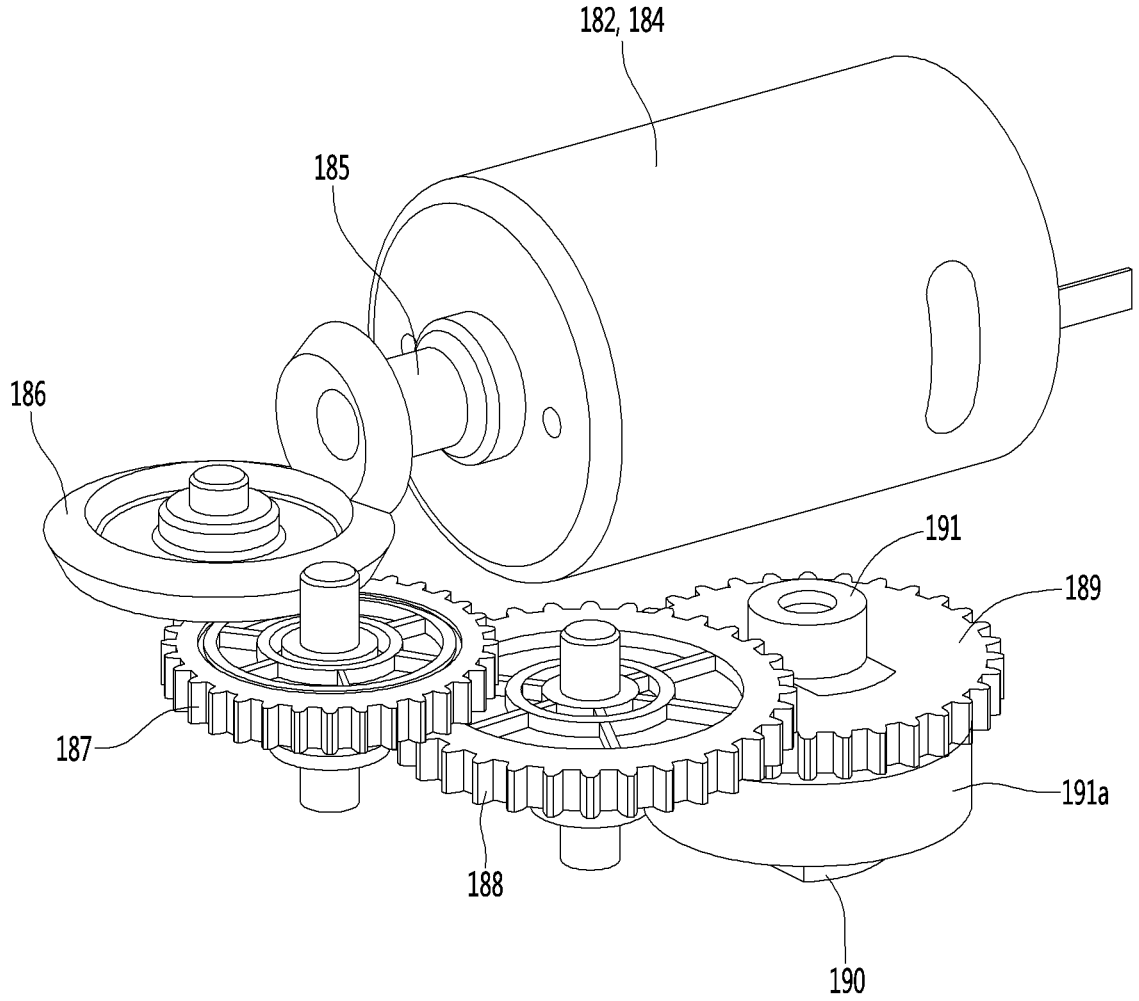
FIG. 23 is a view illustrating an exemplary configuration which a power transmission part is coupled to a driving motor according to an exemplary embodiment.

FIG. 20 is a view of the first and second driving devices 170 and 171 when viewed from the lower side according to an exemplary embodiment, FIG. 21 is a view of the first and second driving devices 170 and 171 when viewed from the upper side according to an exemplary embodiment, FIG. 22 is a view illustrating the motor housing and the structure for preventing the driving motor from rotating, and FIG. 23 is a view illustrating a state in which the power transmission part is coupled to the driving motor according to an exemplary embodiment.

Referring to FIGS. 20 to 23, the first driving device 170 and the second driving device 171 may be horizontally symmetrical to each other.

The first driving device 170 may include a first driving motor 182, and the second driving device 171 may include a second driving motor 184.

A motor printed circuit board (PCB) 350 for driving the motor may be connected to each of the driving motors 182 and 184. The motor PCB 350 may be connected to the driving motors 182 and 184, for example, in a state of standing-up state.

A pair of resistors 352 and 354 for improving performance of an electromagnetic interference (EMI) of the driving motor may be disposed on the motor PCB 350. One resistor of the pair of resistors 352 and 354 may be connected to a positive (+) terminal of the driving motor, and the other resistor may be connected to a negative (−) terminal of the driving motor to reduce a fluctuation in output of the driving motor. For example, the pair of resistors 352 and 354 may be disposed to be horizontally spaced apart from each other on the motor PCB 350.

Each of the driving devices 170 and 171 may include a motor housing. A power transmission part for transmitting power of the driving motors 182 and 184 may be accommodated in the motor housing.

For example, the motor housing may include a first housing 172 and a second housing 173 coupled to an upper portion of the first housing 172.

In the state in which each of the driving motors 182 and 184 are installed in the motor housing, a shaft of each of the driving motors 182 and 184 may extend in a direction parallel to the horizontal direction.

A shaft hole 175 through which the transmission shaft 190 coupled to each of the rotation plates 420 and 440 in the power transmission part may be formed in the first housing 172. For example, a portion of the transmission shaft 190 may pass through a lower portion of the motor housing to protrude downward.

A horizontal cross-section of the transmission shaft 190 may have a non-circular shape to prevent the transmission shaft 190 from relatively rotating in the state of being coupled to the rotation plates 420 and 440.

A sleeve 174 may be disposed around the shaft hole 175 in each of the first and second housings 172 and 173. The sleeve 174 may protrude from a bottom surface of each of the first and second housings 172 and 173.

For example, the sleeve 174 may have a ring shape. The sleeve 174 may be seated on the seating groove 116 that may have a circular shape.

The driving motor 182 and 184 may be seated in the first housing 172. In this state, the driving motors 182 and 184 may be fixed to the first housing 172 by a motor fixing part 183.

Each of the driving motors 182 and 184 may have a cylindrical shape. In a state in which an axial line of each of the driving motors 182 and 184 is horizontally disposed (e.g., a state in which the driving motors 182 and 184 are installed), the driving motors 182 and 184 may be seated in the first housing 172.

The motor fixing part 183 may have an approximately semicircular shape to surround a portion of each of the driving motors 182 and 184 seated in the first housing 172. The motor fixing part 183 may be fixed to the first housing 172 by a coupling member such as, for example, a screw.

The second housing 173 may include a motor cover **173*d* covering a portion of each of the driving motors 182 and 184**.

The motor cover **173*d* may have, for example, a rounded shape to surround the motor fixing part 183 outside the motor fixing part 183**.

For example, the motor cover **173*d* may have a rounded shape so that a portion of the second housing 173** protrudes upward.

Rotation prevention ribs **173*a* and 173*b* may be disposed on a surface of the motor cover 173*d*, which faces the motor fixing part 183, to prevent the motor cover 173*d* from relatively rotating with respect to the motor fixing part 183 while the driving motors 182 and 184 operate, and a rib accommodation slot 183*a* into which the rotation prevention ribs 173*a* and 173*b* are accommodated may be formed in the motor fixing part 183**.

Although not limited, each of the rotation prevention ribs **173*a* and 173*b* may have the same width as the rib accommodation slot 183*a***.

Alternatively, the plurality of rotation prevention ribs **173*a* and 173*b* may be disposed to be spaced apart from each other on the motor cover 173*d* in a circumferential direction of the driving motors 182 and 184, and also, the plurality of rotation prevention ribs 173*a* and 173*b* may be accommodated in the rib accommodation slot 183*a***.

Here, a maximum width of each of the plurality of rotation prevention ribs **173*a* and 173*b* in the circumferential direction of the driving motors 182 and 184 may be equal to or slightly less than a width of the rib accommodation slot 183*a***.

The power transmission part may include a driving gear 185 connected to the shaft of each of the driving motors 182 and 184 and a plurality of transmission gears 186, 187, 188, and 189 that transmit rotation force of the driving gear 185.

The axial lines A3 and A4 of the driving motors 182 and 184 may extend in the horizontal plane. The axial lines A3 and A4 may extend in the front-rear direction. In some exemplary embodiments, the axial lines A3 and A4 may be inclined relative to the front-rear direction. A rotation central line of each of the rotation plates 420 and 440 may extend in the vertical direction. Thus, the driving gear 185 may be, for example, a spiral bevel gear.

The plurality of transmission gears 186, 187, 188, and 189 may include a first transmission gear 186 engaged with the driving gear 185. A rotation center of the first transmission gear 186 may extend in the vertical direction. The first transmission gear 186 may include the spiral bevel gear so that the first transmission gear 186 is engaged with the driving gear 185.

Also, the first transmission gear 186 may further include a helical gear disposed below the spiral bevel gear as a two-stage gear (e.g., a stepped gear).

The plurality of transmission gears 186, 187, 188, and 189 may further include a second transmission gear 187 engaged with the first transmission gear 186.

The second transmission gear 187 may be a two-stage helical gear. For example, the second transmission gear may include two helical gears that are arranged in the vertical direction, and the upper helical gear may be connected to the helical gear of the second transmission gear 187.

The plurality of transmission gears 186, 187, 188, and 189 may further include a third transmission gear 188 engaged with the second transmission gear 187.

The third transmission gear 188 may be a two-stage helical gear. For example, the third transmission gear may include two helical gears that are arranged in the vertical direction, and the upper helical gear may be connected to the lower helical gear of the second transmission gear 187.

The plurality of transmission gears 186, 187, 188, and 189 may further include a fourth transmission gear 189 engaged with the third transmission gear 188. The fourth transmission gear 189 may be a helical gear.

A transmission shaft 190 may be coupled to the fourth transmission gear 189. The transmission shaft 190 may be coupled to pass through the fourth transmission gear 189. Also, an upper bearing 191 may be coupled to an upper end of the transmission shaft 190 passing through the fourth transmission gear 189, and lower bearing 191*a* may be coupled to the transmission shaft 190 below the fourth transmission gear 189. The transmission shaft 190 may rotate together with the fourth transmission gear 189.

Figure 24:
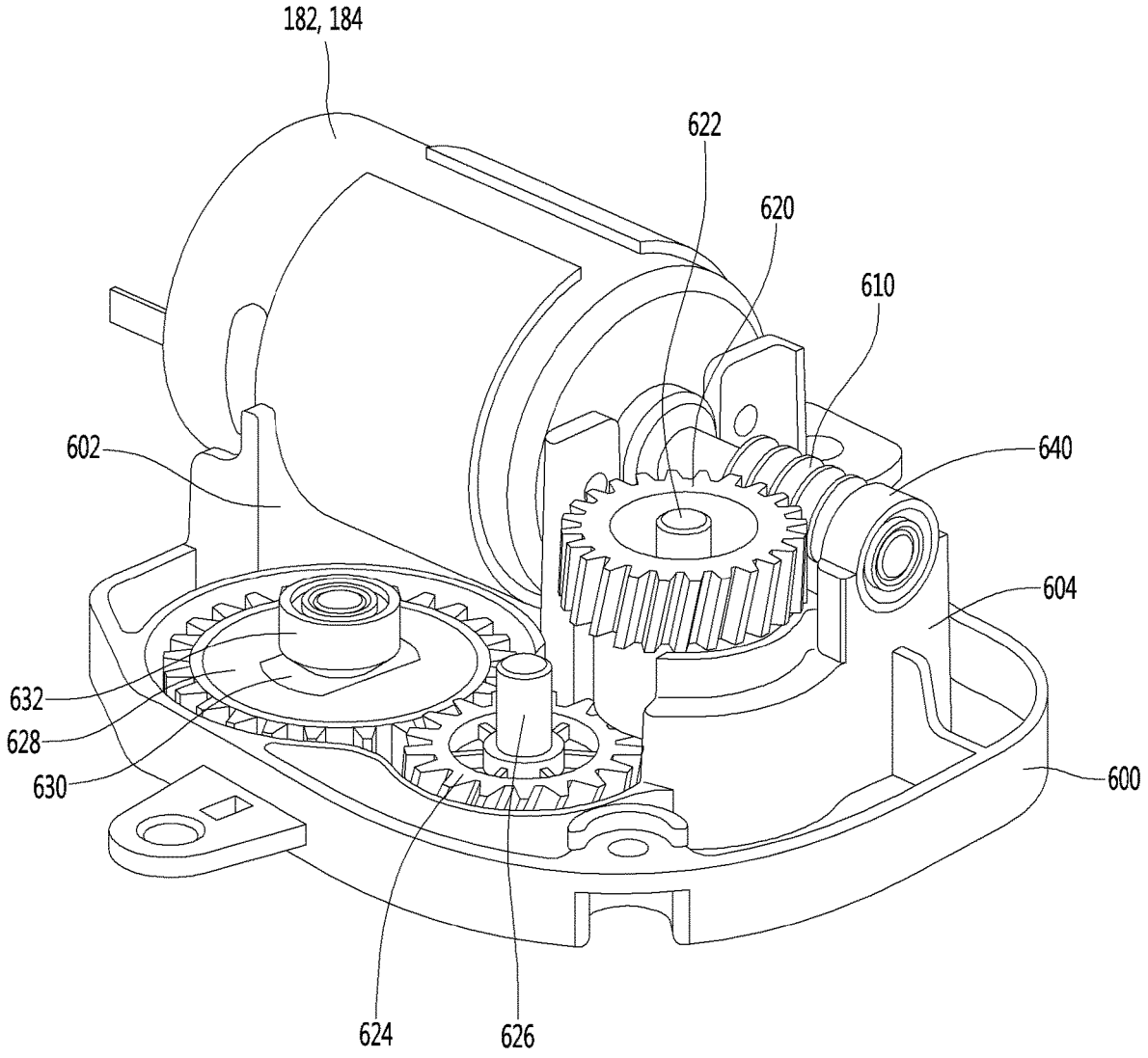
FIG. 24 is a view illustrating a state in which a power transmission part is coupled to a driving motor according to another exemplary embodiment.

FIG. 24 is a view illustrating a state in which the power transmission part is coupled to the driving motor according to another exemplary embodiment.

The disclosed exemplary embodiment may be similar to the foregoing exemplary embodiment except for the power transmission part.

Referring to FIG. 24, the power transmission part according to the disclosed exemplary embodiment may include a driving gear 610 connected to the shaft of each of the driving motors 182 and 184.

The driving gear 610 may be a worm gear. The rotation shaft of the driving gear 610 may extend in the horizontal plane. The rotation shaft of the driving gear 610 may extend in the front-rear direction. A bearing 640 may be connected to the driving gear 610. The first housing 600 supporting the driving motors 182 and 184 may include a motor support part 602 supporting the driving motors 182 and 184 and a bearing support part 604 supporting the bearing 640.

The power transmission part may further include a plurality of transmission gears 620, 624, and 628 for transmitting the rotation force of the driving gear 610 to the rotation plates 420 and 440.

The plurality of transmission gears 620, 624, and 628 may further include a first transmission gear 620 engaged with the driving gear 610. The first transmission gear 620 may include an upper worm gear engaged with the driving gear 610.

As described above, since the driving gear 610 and the first transmission gear 620 are engaged with each other in the form of the worm gear, noise generated due to friction, while the rotation force of the driving gear 610 is transmitted to the first transmission gear 620, may be reduced.

The first transmission gear 620 may include a helical gear disposed below the upper worm gear as a two-stage gear.

The first transmission gear 620 may be rotatably connected to the first shaft 622 extending in the vertical direction. The first shaft 622 may be fixed to the first housing 600.

Thus, the first transmission gear 620 may rotate with respect to the first shaft 622. According to the disclosed exemplary embodiment, the first transmission gear 620 may be configured to rotate with respect to the first shaft 622, and thus, a bearing may be unnecessary.

The plurality of transmission gears 620, 624, and 628 may further include a second transmission gear 624 engaged with the first transmission gear 620. For example, the second transmission gear 624 may be a helical gear.

The second transmission gear 624 may be rotatably connected to a second shaft 626 extending in the vertical direction. The second shaft 626 may be fixed to the first housing 600.

Thus, the second transmission gear 624 may rotate with respect to the second shaft 626. According to the disclosed exemplary embodiment, the second transmission gear 624 may be configured to rotate with respect to the second shaft 626, and thus, a bearing may be unnecessary.

The plurality of transmission gears 620, 624, and 628 may further include a third transmission gear 628 engaged with the second transmission gear 624. The third transmission gear 628 may be, for example, a helical gear.

The third transmission gear 628 may be connected to a transmission shaft 630 connected to the rotation plates 420 and 440. The transmission shaft 630 may be connected to the third transmission gear 628 to rotate together with the third transmission gear 628.

A bearing 632 may be coupled to the transmission shaft 630 so that the transmission shaft 630 smoothly rotates.

<Arrangement of Driving Device on Nozzle Base>

Figure 25:
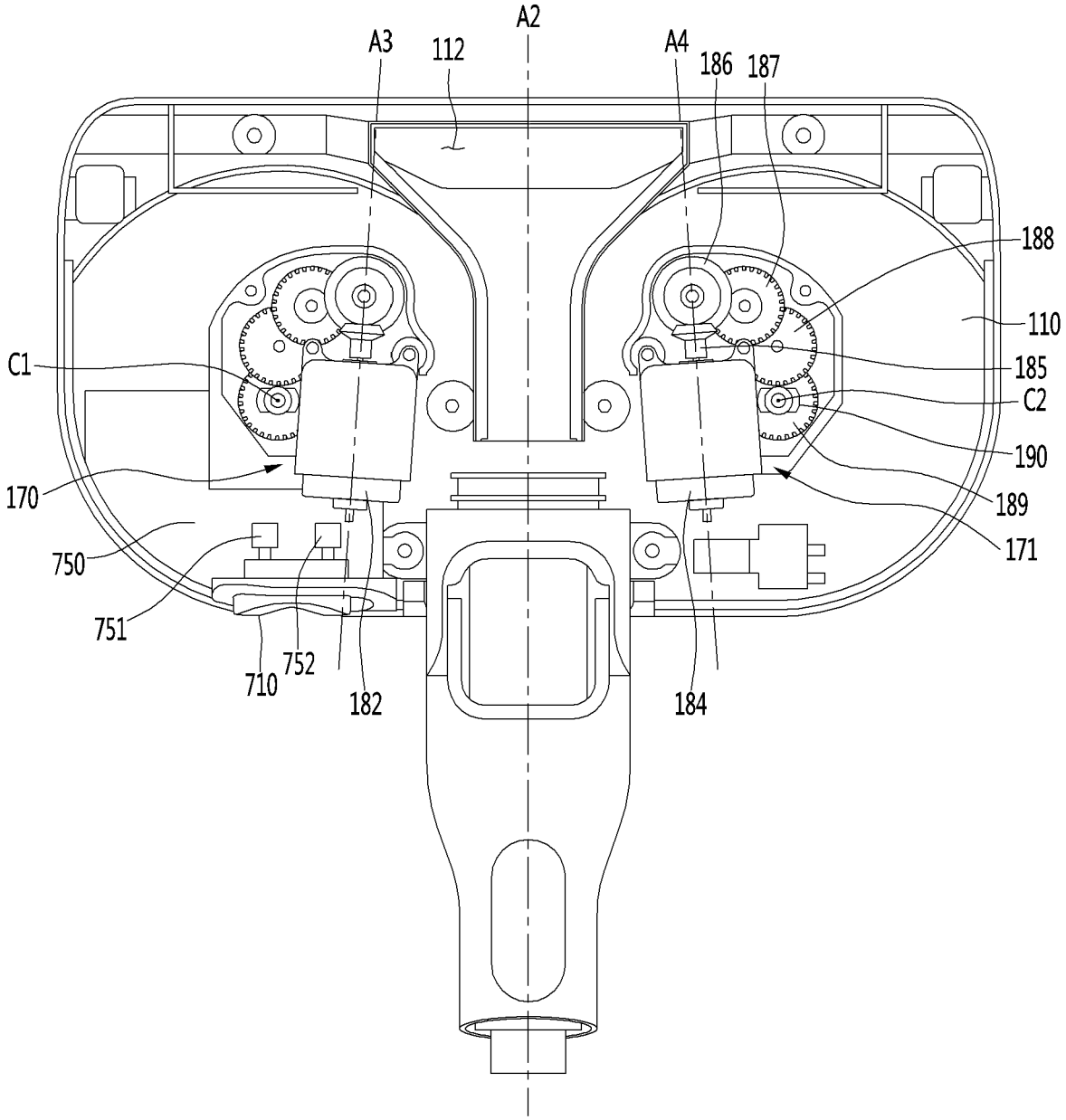
FIG. 25 is a plan view illustrating a state in which a driving device is installed on a nozzle base according to an exemplary embodiment.
Figure 26:
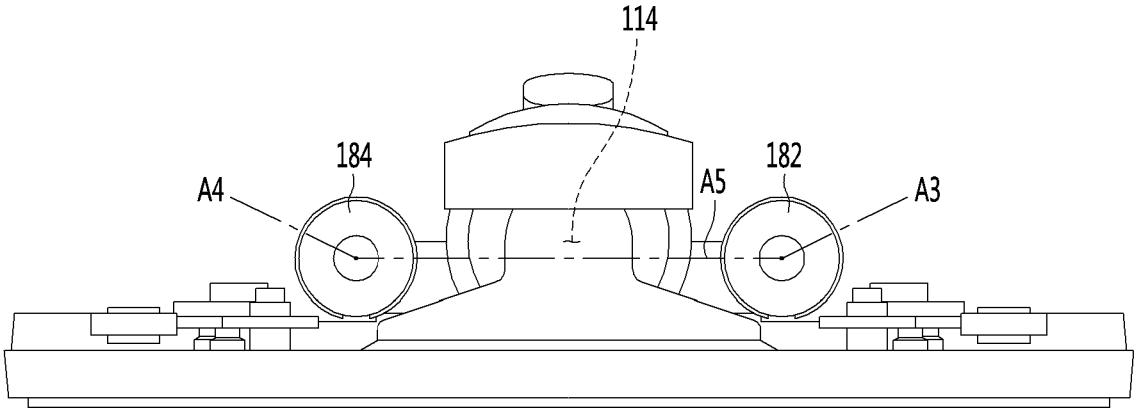
FIG. 26 is a front view illustrating the state in which a driving device is installed on the nozzle base according to an exemplary embodiment.

FIG. 25 is a plan view illustrating a state in which the driving device is installed on the nozzle base 110 according to an exemplary embodiment, and FIG. 26 is a front view illustrating the state in which the driving device is installed on the nozzle base 110 according to an exemplary embodiment.

However, a state in which the second housing of the motor housing of FIG. 25 is removed is illustrated.

Referring to FIGS. 25 and 26, as described above, the driving devices 170 and 171 may be disposed to be horizontally spaced apart from each other on the nozzle base 110.

Here, the central line A2 of the second passage 114 may be disposed between the first driving device 170 and the second driving device 171.

Although not limited, the axial line A3 of the first driving motor 182 and the axial line A4 of the second driving motor 184 may extend in the front-rear direction.

The axial line A3 of the first driving motor 182 and the axial line A4 of the second driving motor 184 may be parallel to each other or may be angled at a predetermined angle.

In the disclosed exemplary embodiment, a virtual line connecting the axial line A3 of the first driving motor 182 to the axial line A4 of the second driving motor 184 may pass through the second passage 114. This is because each of the driving motors 182 and 184 may be disposed close to a rear side of the nozzle 1. Thus, a height of the nozzle 1 due to each of the driving motors 182 and 184 may be prevented from increasing.

To minimize the increase in height of the nozzle 1 due to each of the driving motors 182 and 184, the driving gear 185 may be disposed between the driving motors 182 and 184 and the first passage 112 in the state in which the driving gear 185 is connected to the shafts of the driving motors 182 and 184.

In this case, since each of the driving motors 182 and 184 having a long vertical length in the driving devices 170 and 171 is disposed close to the rear side within the nozzle body 10, the increase in height of the front end of the nozzle 1 may be minimized.

Since the driving devices 170 and 171 are disposed close to the rear side of the nozzle 1, and the water tank 200 is disposed above the driving devices 170 and 171, the center of gravity of the nozzle 1 may lean to the rear side of the nozzle 1 due to the water within the water tank 200 and the weight of the driving devices 170 and 171.

Thus, in the disclosed exemplary embodiment, the connection chamber (see reference numeral 226 of FIG. 11) of the water tank 200 may be disposed between the first passage 112 and the driving devices 170 and 171 with respect to the front-rear direction of the nozzle 1.

In the disclosed exemplary embodiment, rotation centers C1 and C2 of the rotation plates 420 and 440 may correspond to a rotation center of the transmission shaft 190.

The axial lines A3 and A4 of the driving motors 182 and 184 may be disposed in a region between the rotation centers C1 and C2 of the rotation plates 420 and 440.

Also, each of the driving motors 182 and 184 may be disposed in the region between the rotation centers C1 and C2 of the rotation plates 420 and 440.

Also, each of the driving motors 182 and 184 may be disposed to vertically overlap a virtual line connecting the first rotation center C1 to the second rotation center C2.

<Rotation Plate>

Figure 27:
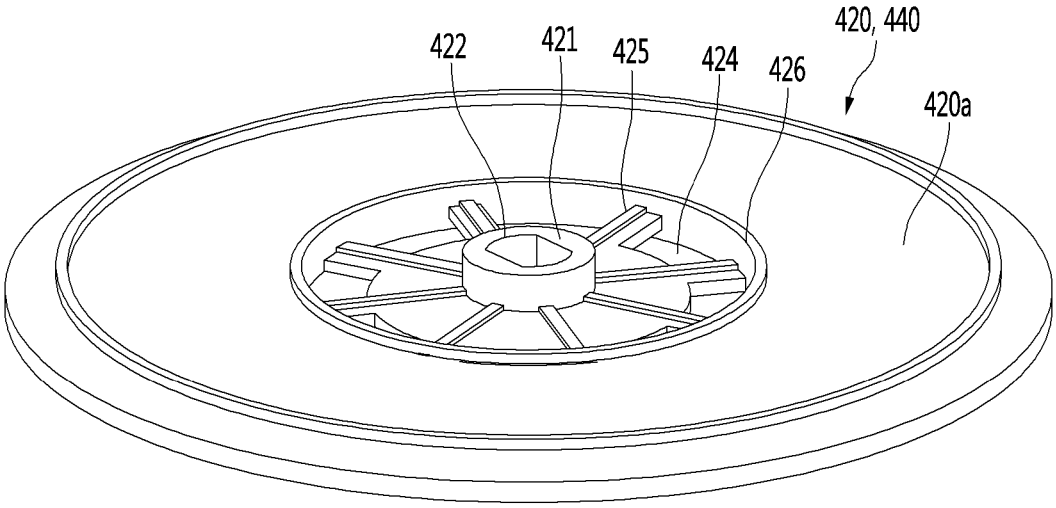
FIG. 27 is a view of a rotation plate when viewed from the upper side according to an exemplary embodiment.
Figure 28:
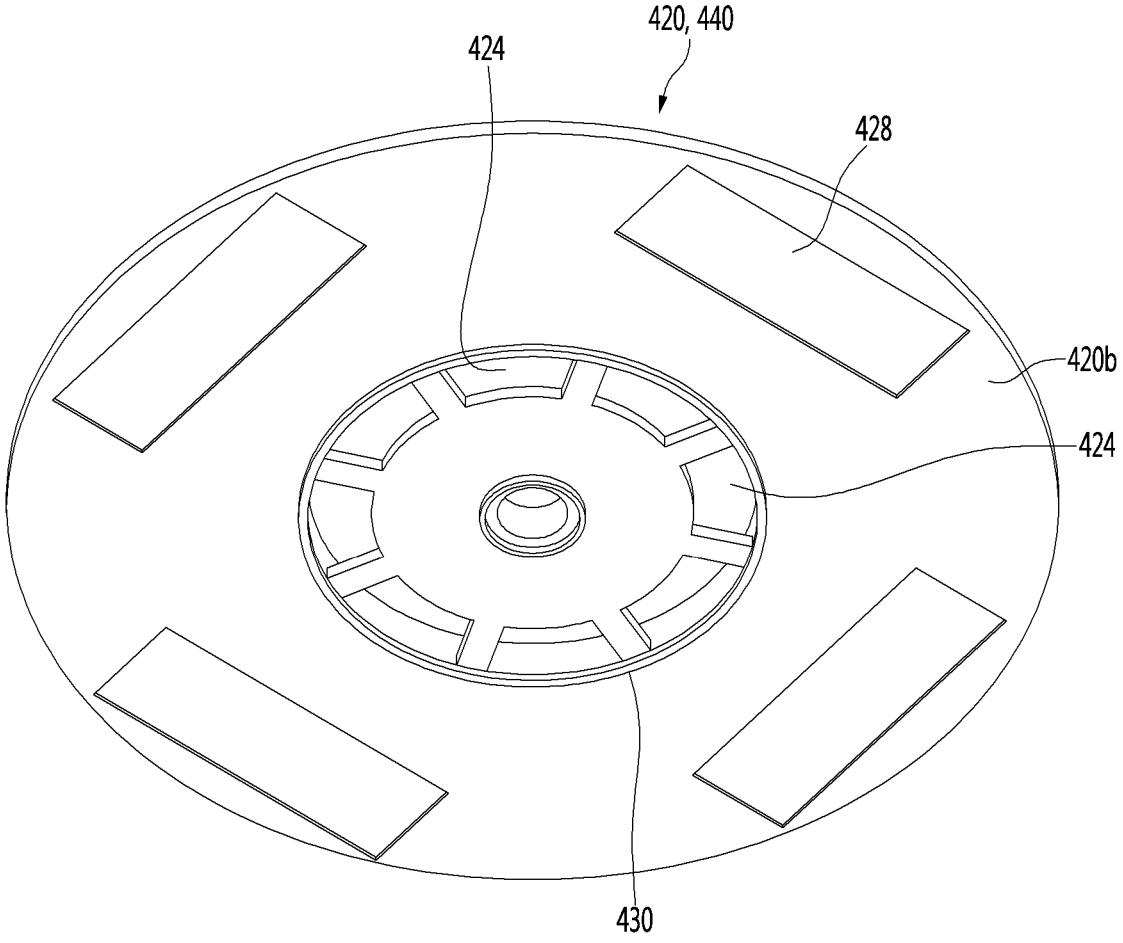
FIG. 28 is a view of a rotation plate when viewed from the lower side according to an exemplary embodiment.

FIG. 27 is a view of a rotation plate when viewed from the upper side according to an exemplary embodiment, and FIG. 28 is a view of the rotation plate when viewed from the lower side according to an exemplary embodiment.

Referring to FIGS. 27 and 28, each of the rotation plates 420 and 440 may be provided with a shaft coupling part 421 to which the transmission shaft 190 may be coupled to a central portion thereof.

For example, the transmission shaft 190 may be inserted into the shaft coupling part 421. For this, a shaft accommodation groove 422 into which the transmission shaft 190 is inserted may be formed in the shaft coupling part 421.

In the state in which the transmission shaft 190 may be coupled to the shaft coupling part 421, the coupling member below the rotation plates 420 and 440 may be inserted into the shaft coupling part 421 so as to be coupled to the transmission shaft 190.

The rotation plates 420 and 440 may include a plurality of water passing holes 424 formed outside the shaft coupling part 421 in the radial direction.

In the disclosed exemplary embodiment, since the rotation plates 420 and 440 rotate in the state in which the rags 402 and 404 are attached to the lower portions of the rotation plates 420 and 440, the plurality of water passing holes 424 may be disposed to be spaced apart from each other in the circumferential direction with respect to the shaft coupling part 421 so that water passes through the rotation plates 420 and 440 so as to be smoothly supplied to the rags 402 and 404.

The plurality of water passing holes 424 may be partitioned by a plurality of ribs 425. Here, each of the ribs 425 may be disposed lower than a top surface 420*a* of each of the rotation plates 420 and 440.

Since the rotation plates 420 and 440 may rotate, centrifugal force may act on the rotation plates 420 and 440. Water injected to the rotation plates 420 and 440 may be prevented from flowing radially outward in a state in which water does not pass through the water passing holes 424 in the rotation plates 420 and 440 due to the centrifugal force.

A water blocking rib 426 may be disposed outside the water passing hole 424 in the radial direction on the top surface 420*a* of each of the rotation plates 420 and 440. The water blocking rib 426 may be continuously provided in the circumferential direction. The plurality of water passing holes 424 may be disposed in an internal region of the water blocking rib 426. The water blocking rib 426 may have, for example, a circular ring shape.

An installation groove 428 may be formed in the bottom surface 420*b* of each of the rotation plates 420 and 440. An attachment unit, to which each of the rags 402 and 404 is attached, may be installed in the installation groove 428. The attachment unit may include a hook-and-loop material, such as products sold under the trademark Velcro.

The plurality of installation grooves 428 may be disposed to be spaced apart from each other in the circumferential direction with respect to the rotation centers C1 and C2 of the rotation plates 420 and 440. Thus, the plurality of attachment units may be disposed on bottom surfaces 420*b* of the rotation plates 420 and 440.

In the disclosed exemplary embodiment, the installation grooves 428 may be radially disposed outside the water passing holes 424 with respect to the rotation centers C1 and C2 of the rotation plates 420 and 440.

For example, the water passing holes 424 and the installation grooves 428 may be sequentially arranged in the radial outward direction from the rotation centers C1 and C2 of the rotation plates 420 and 440.

A contact rib 430 contacting each of the rags 402 and 404 in the state of contacting the attachment unit may be disposed on the bottom surface 420*b* of each of the rotation plates 420 and 440.

The contact rib 430 may protrude downward from the bottom surface 420*b* of each of the rotation plates 420 and 440.

The contact rib 430 may be disposed outside the water passing hole 424 in the radial direction and may be continuously provided in the circumferential direction. For example, the contact rib 430 may have a circular ring shape.

Because the rags 402 and 404 may be formed from a fiber material, a gap may exist between the rag 402 or the rag 404 and the bottom surface 420*b* of each of the rotation plates 420 and 440 while the rags 402 and 404 are attached to the rotation plates 420 and 440 by the attachment unit.

When the gap existing between each of the rags 402 and 404 and the bottom surface 420*b* of the rotation plates 420 and 440, such as that discussed above, is large, water may flow to the outside through the gap between the bottom surface 420*b* of each of the rotation plates 420 and 440 and each of the rags 402 and 404 without being absorbed into the rags 402 and 404 in the state of passing through the water passing holes 424.

However, according the disclosed exemplary embodiment, when the rags 402 and 404 are coupled to the rotation plates 420 and 440, the contact rib 430 may contact each of the rags 402 and 404, and when the nozzle 1 is placed on the floor, the contact rib 430 may press each of the rags 402 and 404 by the weight of the nozzle 1.

Thus, the gap may be prevented from forming between the bottom surface 420*b* of each of the rotation plates 420 and 440 and the top surface of each of the rags 402 and 404 due to the contact rib 430, and thus, the water passing through the water passing hole 424 may be smoothly supplied to the rags 402 and 404.

<Water Supply Passage>

Figure 29:
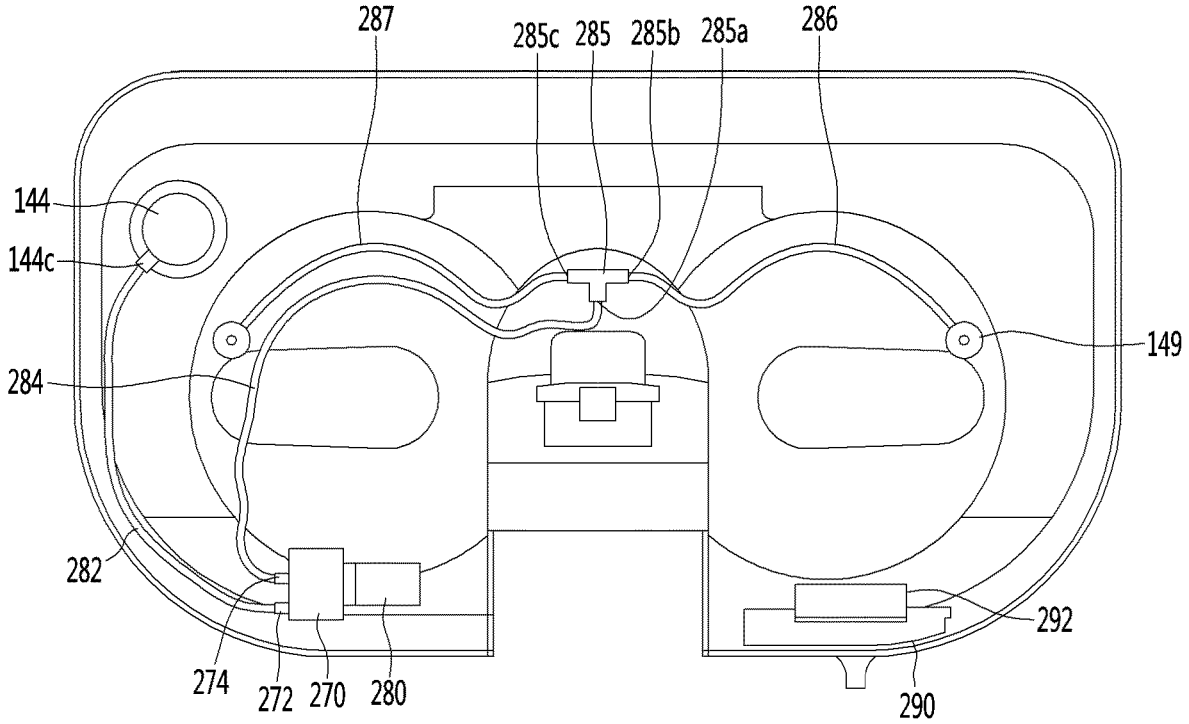
FIG. 29 is a view of a water supply passage for supplying water of a water tank to a rotation cleaning part according to an exemplary embodiment.
Figure 30:
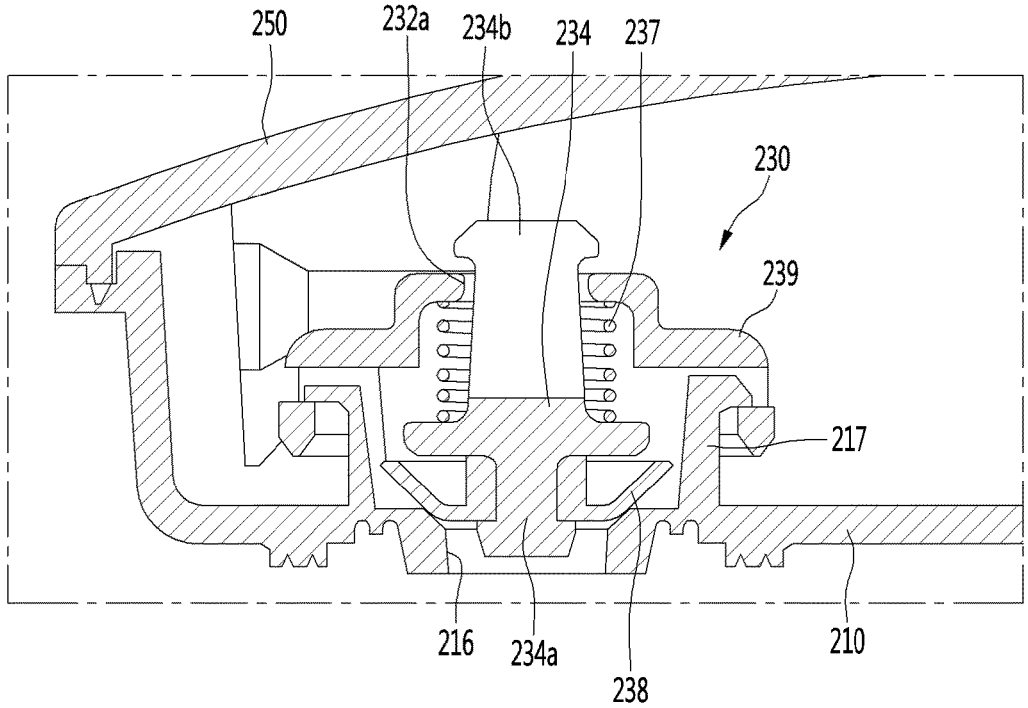
FIG. 30 is a view of a valve within a water tank according to an exemplary embodiment.
Figure 31:
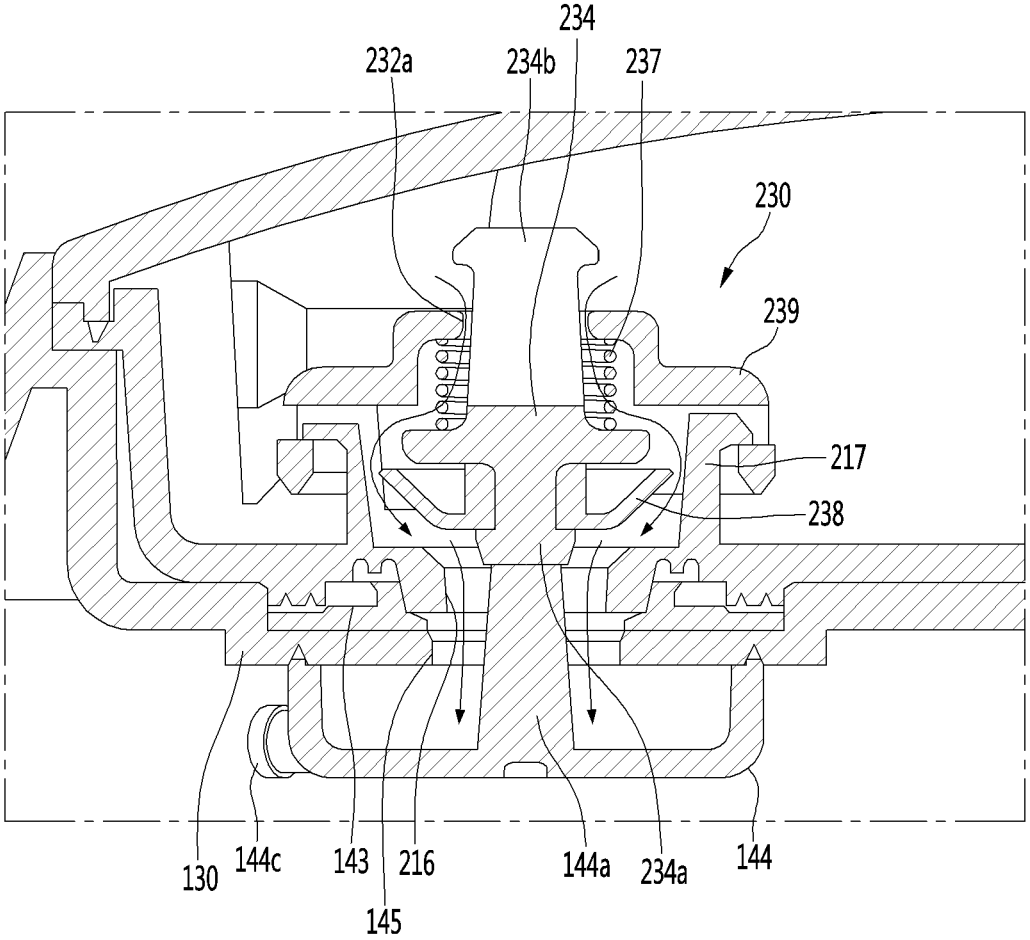
FIG. 31 is a view illustrating an exemplary embodiment in a state in which a valve opens a discharge hole in a state of being mounted on the nozzle housing.

FIG. 29 is a view of the water supply passage for supplying water of the water tank 200 to a rotation cleaning part according to an exemplary embodiment, FIG. 30 is a view of a valve within the water tank 200 according to an exemplary embodiment, and FIG. 31 is a view illustrating a state in which the valve opens a discharge hole in a state of being mounted on the nozzle housing 100.

Figure 32:
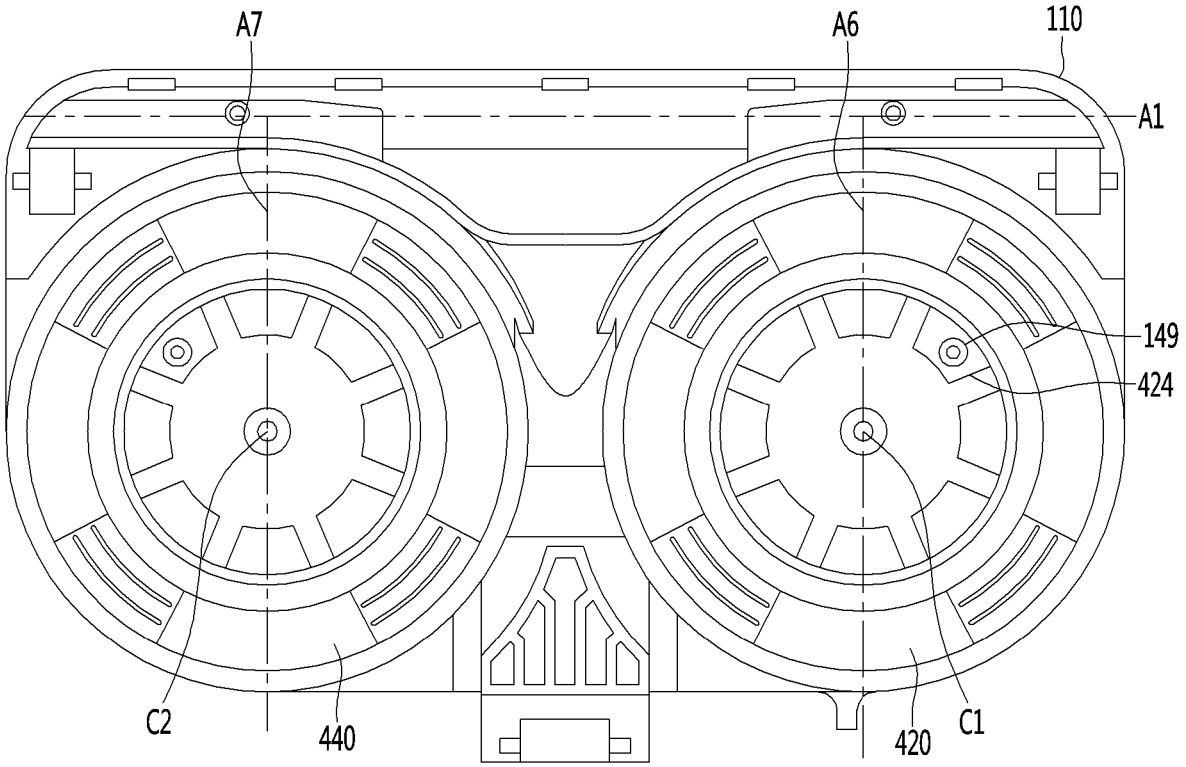
FIG. 32 is a view illustrating a configuration in which a rotation plate is coupled to a nozzle body according to an exemplary embodiment.
Figure 33:
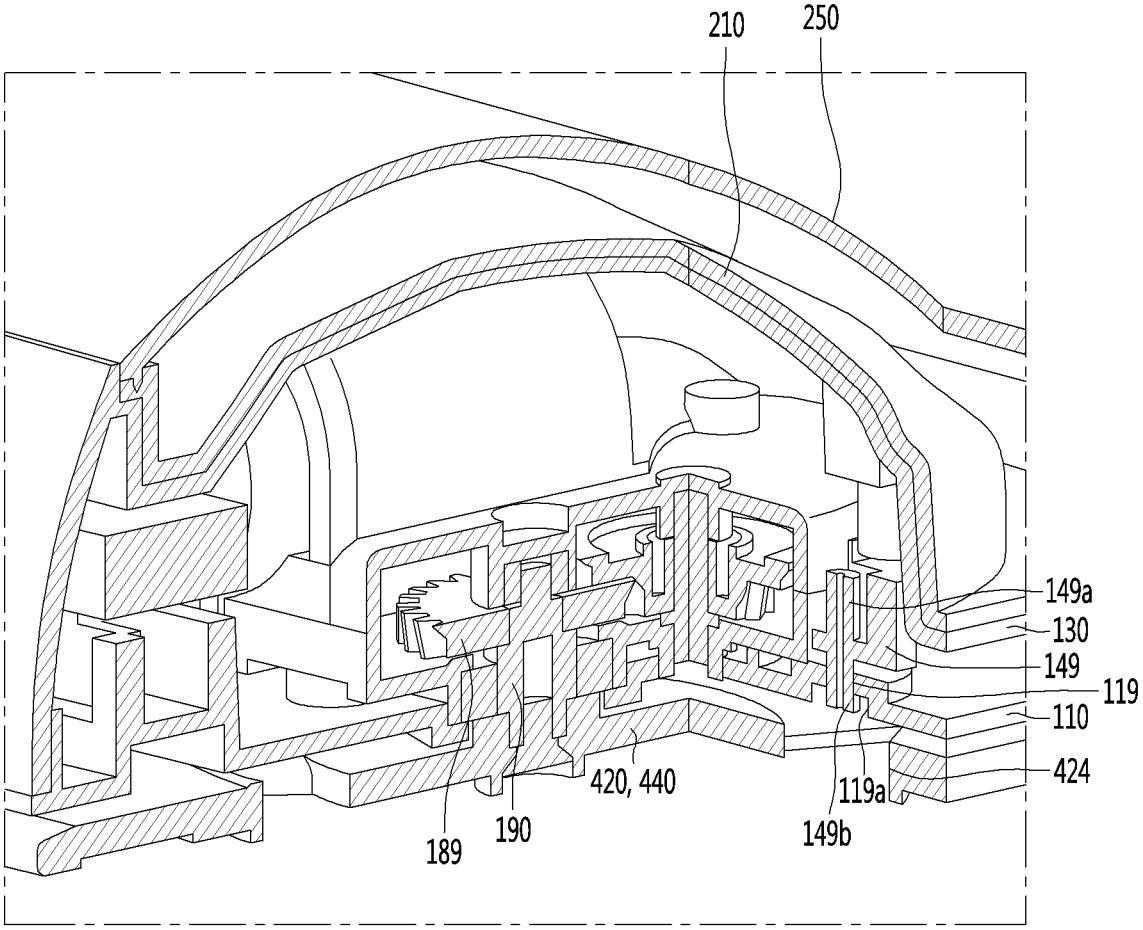
FIG. 33 is a view illustrating an arrangement of an injection nozzle in a nozzle body according to an exemplary embodiment.

FIG. 32 is a view illustrating a state in which a rotation plate is coupled to the nozzle body 10 according to an exemplary embodiment, and FIG. 33 is a view illustrating an arrangement of an injection nozzle in the nozzle body 10 according to an exemplary embodiment.

Figure 34:
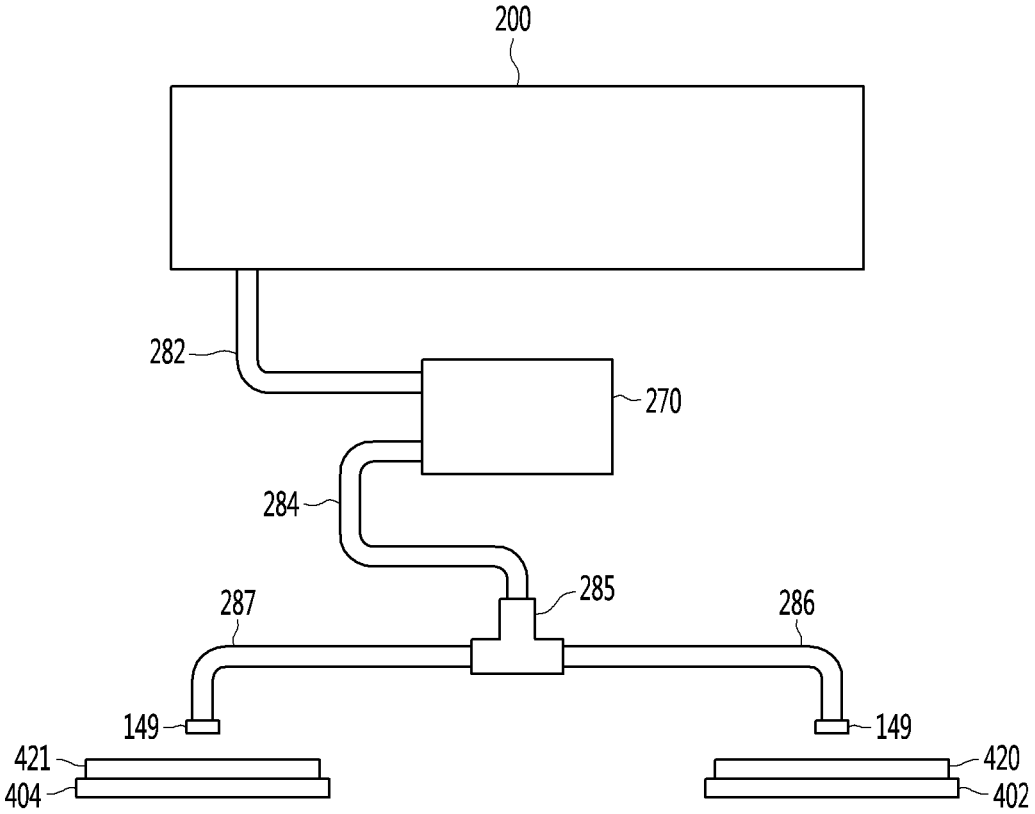
FIG. 34 is a conceptual view illustrating a process of supplying water from a water tank to a rotation cleaning part according to an exemplary embodiment.

FIG. 34 is a conceptual view illustrating a process of supplying water from the water tank 200 to the rotation cleaning part according to an exemplary embodiment.

Referring to FIGS. 29 to 34, the water supply passage according to the disclosed exemplary embodiment may include a first supply tube 282 connected to the valve manipulation part 144, a water pump 270 connected to the first supply tube 282, and a second supply tube 284 connected to the water pump 270.

The water pump 270 may include a first connection port 272 to which the first supply tube 282 may be connected and a second connection port 274 to which the second supply tube 284 may be connected. The first connection port 272 may be an inlet, and the second connection port 274 may be outlet with respect to the water pump 270.

Also, the water supply passage may further include a connector 285 to which the second supply tube 284 is connected.

The connector 285 may have a shape in which a first connection part 285*a*, a second connection part 285*b*, and a third connection part 285*c* are arranged in the form of a T shape. The second supply tube 284 may be connected to the first connection part 285*a*.

The water supply passage may further include a first branch tube 286 connected to the second connection part 285*b* and a second branch tube 287 connected to the third connection part 286*c*.

Thus, water flowing through the first branch tube 286 may be supplied to the first rotation cleaning part 40, and water flowing through the second branch tube 287 may be supplied to the second rotation cleaning part 41.

Since the branch tubes 286 and 287 may have the same length, the connector 285 may be disposed at a central portion of the nozzle body 10.

For example, the connector 285 may be disposed below the passage cover 136 and above the passage formation part 150. That is, the connector 285 may be disposed vertically above the second passage 114. Thus, substantially the same amount of water may be distributed from the connector 285 into the branch tubes 286 and 287.

In the disclosed exemplary embodiment, the water pump 270 may be disposed at one point on the water supply passage.

Here, the water pump 270 may be disposed between the valve manipulation part 144 and the first connection part 285*a* of the connector 285 so that water discharge from the water tank 200 may be adjusted by using the minimum number of water pumps.

In the disclosed exemplary embodiment, the water pump 270 may be installed on the nozzle cover 130 in a state of being disposed close to a portion at which the valve manipulation part 144 is installed. For example, the valve manipulation part 144 and the water pump 270 may be provided at one side among left and right sides of the nozzle body 10 with respect to the central line A2 of the second passage 114 in the nozzle body 10.

Thus, the first supply tube 282 may be reduced in length. As a result, the water supply passage may be reduced in length.

Each of the branch tubes 286 and 287 may be connected to the injection nozzle 149. The injection nozzle 149 may also constitute the water supply passage according to an exemplary embodiment.

As described above, the injection nozzle 149 may include a connection part 149*a* connected to each of the branch tubes 286 and 287.

The injection nozzle 149 may further include a nozzle end 149*b*. The nozzle end 149*b* passes through the nozzle hole 119 to extend downward. The nozzle end 149*b* may be disposed outside the nozzle housing 100.

As described above, when the nozzle end 149*b* is disposed outside the nozzle housing 100, the water injected through the nozzle end 149*b* may be prevented from being introduced into the nozzle housing 100.

Here, to prevent the nozzle end 149*b* exposed to the outside of the nozzle housing 100 from being damaged, a groove 119*a* that is recessed upward may be formed in the bottom surface of the nozzle base 110, and the nozzle end 149*b* may be disposed within the groove 119*a* in the state of passing through the nozzle hole 119. That is, the nozzle hole 119 may be formed in the groove 119*a*.

Also, the nozzle end 149*b* may be disposed in the groove 119*a* to face the rotation plates 420 and 440.

Thus, the water injected from the nozzle end 149*b* may pass through the water passing hole 424 of each of the rotation plates 420 and 440.

A line perpendicularly connecting the first rotation center C1 to the central line A1 of the first passage 112 (e.g., in an up-down direction in the view of FIG. 32) may be called a first connection line A6, and a line perpendicularly connecting the second rotation center C2 to the axial line A1 of the first passage 112 may be called a second connection line A7.

Here, the first connection line A6 and the second connection line A7 may be disposed in a region between the pair of injection nozzles 149 for supplying water to the rotation cleaning parts 40 and 41.

This is because the injection nozzle 149 may be disposed to prevent components from interfering with each other because the components constituting the driving devices 170 and 171 exist in the region between the first connection line A6 and the second connection line A7.

Also, a horizontal distance between the injection nozzle 149 and the central line A1 of the first passage 112 may be less than that between each of the rotation centers C1 and C2 and the central line A1 of the first passage 112.

The valve 230 may include a movable part 234, a switching part 238, and a fixed part 239.

The fixed part 239 may be fixed to a fixing rib 217 that protrudes upward from the first body 210.

An opening 232*a* through which the movable part 234 passes may be formed in the fixed part 232.

The fixed part 239 may limit movement of the movable part 234 upward from the fixed part 239 by a predetermined height in a state of being coupled to the fixing rib 217.

A portion of the movable part 234 may be movable vertically in a state of passing through the opening 232*a*. In the state in which the movable part 234 moves upward, water may pass through the opening 232*a*.

The movable part 234 may include a first extension part 234*a* extending downward so that the switching part 238 is coupled and a second extension part 234*b* extending upward to pass through the opening 232*a*.

The movable part 234 may be elastically supported by an elastic member 237. The elastic member 237 may be, for example, a coil spring. The elastic member 237 may have one end fixed to the fixed part 239 and the other end supported by the movable part 234.

The elastic member 237 may provide force, by which the movable part 234 moves downward, to the movable part 234.

The switching part 238 may selectively open the discharge hole 216 through the vertical movement of the movable part 234.

At least a portion of the switching part 238 may have a diameter greater than that of the discharge hole 216 so that the switching part 238 blocks the discharge hole 216.

The switching part 238 may be made of, for example, a rubber material to prevent water from leaking in the state of blocking the discharge hole 216.

The elastic force of the elastic member 237 may act on the movable part 234 so that the state in which the switching part 238 blocks the discharge hole 216 is maintained unless external force is applied to the movable part 234.

The movable part may move by the valve manipulation part 144 while the water tank 200 is mounted on the nozzle body 10.

As described above, the valve manipulation part 144 is disposed below the nozzle cover 130 so as to be coupled to the nozzle cover 130. A water passing hole 145 through which water discharged from the water tank 200 passes may be formed in the nozzle cover 130.

The valve manipulation part 144 may include a pressing part 144*a* passing through the water passing hole 145. The pressing part 144*a* may protrude upward from the bottom surface of the nozzle cover 130 in the state of passing through the water passing hole 145 of the nozzle cover 130.

The valve manipulation part 144 may constitute the water supply passage together with the bottom surface of the nozzle cover 130. Also, a connection tube 144*c* to which the first supply tube 282 is connected may be disposed at one side of the valve manipulation part 144.

The water passing hole 145 may have a diameter greater than an outer diameter of the pressing part 144*a* so that the water smoothly flows in the state in which the pressing part 144*a* passes through the water passing hole 145.

When the water tank 200 is mounted on the nozzle body 10, the pressing part 144*a* may be inserted into the discharge hole 216 of the water tank 200. While the pressing part 144*a* is inserted into the discharge hole 216 of the water tank 200, the pressing part 144*a* may press the movable part 234.

Thus, the movable part 234 may ascend, and the switching part 238 coupled to the movable part 234 may ascend together with the movable part and then be spaced apart from the discharge hole 216 to open the discharge hole 216.

As a result, the water within the water tank 200 may be discharged through the discharge hole 216 to flow along the valve manipulation part 144 through the water passing hole 145 and then be supplied to the first supply tube 282 connected to the connection tube 144*c*.

The water supplied to the first supply tube 282 may be introduced into the water pump 270 to flow to the second supply tube 284. The water flowing to the second supply tube 284 may flow to the first branch tube 286 and the second branch tube 287 by the connector 285. Also, the water flowing to each of the branch tubes 286 and 287 may be injected from the injection nozzle 149 to the rotation cleaning parts 40 and 41.

The water injected from the injection nozzle 149 may pass through the water passing holes 424 of each of the rotation plates 420 and 440 and then be supplied to the rags 402 and 404. The water supplied to the rags 402 and 404 may be absorbed through rotation, and may help to clean the floor.

According to some exemplary embodiments, a passage into which foreign substances on the floor are drawn in may be provided, and also, the rotation plates to which the rags are attached may rotate to clean the floor, thereby improving cleaning performance.

In addition, the water tank may be mounted on the nozzle to supply water to the rags, thereby improving convenience of the user.

According to some exemplary embodiments, the passage may extend forward and backward from the central portion of the nozzle, and the driving devices for the rotation of the rotation cleaning parts may be disposed on both sides of the passage to prevent the air passage through which air flows from increasing in length, thereby preventing a passage loss from increasing.

In addition, according to some exemplary embodiments, since the plurality of rotation members to which the rags are attached are independently driven by the plurality of motors, even though some of the plurality of motors may break down, cleaning may continue to be performed through other motors.

In addition, since the water tank may be disposed to surround the driving part cover covering the driving device, an amount of water to be stored in the water tank may increase, and the total height of the nozzle may be prevented from increasing.

According to some exemplary embodiments, the passage into which the foreign substances on the floor are drawn in may be provided, and also, the rotation plates to which the rags are attached may rotate to clean the floor, thereby improving cleaning performance.

In addition, the water tank may be mounted on the nozzle to supply the water to the rags, thereby improving convenience of the user.

According to some exemplary embodiments, the injection nozzle connected to the end of the water supply passage may be exposed to the outside of the nozzle housing to prevent the water injected from the injection nozzle from being introduced into the nozzle housing.

According to some exemplary embodiments, only one discharge hole may be formed in the water tank, and the water may be branched through the water supply passage so as to be supplied each of the plurality of rotation cleaning parts, thereby minimizing the number of potential water leakage paths.

According to some exemplary embodiments, the discharge hole and the water pump may be disposed at one side of the second passage of the suction passage to minimize the length of the water supply passage.

According to some exemplary embodiments, the connector to which the branch tubes are connected may be disposed above the second passage to supply substantially the same amount of water to the rotation cleaning parts.

According to some exemplary embodiments, the amount of water per unit time, which is supplied to the rag, may be easily adjusted by using the user's hand or foot during the cleaning process.

According to some exemplary embodiments, the water of the water tank may be supplied to the rag, or the water supply to the rag may be cut off through simple manipulation using the user's hand or food during the cleaning process.

According to some exemplary embodiments, the user may confirm the amount of water to be supplied to the rag through by the naked eye to improve the convenience of the user.

Although some exemplary embodiments have been described with reference to a number of illustrative examples, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and which may be expressed in the appended claims. In addition to variations and modifications in the component parts and/or arrangements, alternative uses will also be apparent to those skilled in the art.

What is claimed is:

1. A cleaner comprising:

a suction motor;

a nozzle placed on a floor surface and sucking air containing foreign substances on the floor surface with a suction force generated by the suction motor; and a connection tube connected to a central portion of a rear surface of the nozzle to guide air sucked from the nozzle to a cleaner body provided with the suction motor, wherein the nozzle comprises:

a nozzle body having a suction passage configured to suction the air containing foreign substances, the nozzle body being connected to the connection tube;

a rotation cleaning part rotatably disposed below the nozzle body and provided with at least one rotation plate to which a rag is attached;

a water tank provided on an upper portion of the nozzle body and configured to store water;

a driving motor configured to rotate the at least one rotation plate and which is provided in the nozzle body to be spatially separated from the water tank and the suction passage;

a water supply passage provided in the nozzle body, the water supply passage being configured to supply the water of the water tank to the rotation cleaning part;

a water pump disposed on the water supply passage for controlling water discharged from the water tank; and a water adjusting unit positioned at a rear portion of the nozzle body at a rear of the driving motor and a rear of the water tank to be exposed to a user, wherein the water adjusting unit is configured to adjust an operation of the water pump and is formed to be movable at the rear portion of the nozzle body in a horizontal direction of the nozzle body.

2. The cleaner of claim 1, wherein the water pump has a pump motor, and wherein the water adjusting unit is configured to adjust an on/off operation and a rotational speed of the pump motor.

3. The cleaner of claim 2, wherein the water adjusting unit moves in the horizontal direction by a force, wherein the water adjusting unit comprising:

a first part disposed at a first side of the water adjusting unit; and a second part integrated with the first part, the second part being disposed at a second side of the water adjusting unit, and wherein the first part and the second part are configured to move in the horizontal direction.

4. The cleaner of claim 3, wherein the pump motor rotates:

at a first rotational speed in a state in which the first part is moved in a first direction, and at a second rotation speed greater than the first rotation speed in a state in which the second part is moved in a second direction.

5. The cleaner of claim 4, wherein the first direction is opposite to the second direction.

6. The cleaner of claim 5, wherein, when the water adjusting unit is disposed at a center position, and the pump motor is turned off.

7. The cleaner of claim 1, wherein the nozzle further comprises a control substrate provided as a switching element to electrically connect the water adjusting unit and the water pump, and wherein the control substrate is disposed inside the nozzle body and below the water tank.

8. The cleaner of claim 7, wherein the control substrate includes a first element and a second element operated to control an amount of water discharged by the water pump.

9. The cleaner of claim 8, wherein the water adjusting unit is configured to press a contact point of the first element when the water adjusting unit moves to a first side, and wherein the water adjusting unit is configured to press a contact point of the second element when the water adjusting unit moves to a second side.

10. The cleaner of claim 9, wherein the water pump is configured to operate at a first output to discharge water, when the first element is pressed by the water adjusting unit.

11. The cleaner of claim 10, wherein the water pump is configured to operate at a second output greater than the first output to discharge water, when the second element is pressed by the water adjusting unit.

12. The cleaner of claim 11, wherein, when the water adjusting unit is disposed at an intermediate position between the first side and the second side, the water pump is configured to stop by non-contact of contact points of the first element and the second element.

13. The cleaner of claim 1, wherein the water tank forms an upper surface of the nozzle so as to have a space for storing water to be supplied to the rag.

14. The cleaner of claim 1, wherein a lower surface of the nozzle body has a nozzle hole where an injection nozzle is positioned, and wherein the injection nozzle is configured to discharge water downward so as to supply the water in the water tank to the rotation cleaning part.

15. The cleaner of claim 14, wherein the at least one rotation plate of the rotation cleaning part includes a first rotation plate and a second rotation plate spaced apart from each other in the horizontal direction of the nozzle body, and wherein the rotation cleaning part is positioned at a rear of the suction passage extending the horizontal direction of the nozzle body.

16. The cleaner of claim 15, wherein a horizontal distance between the injection nozzle and the suction passage extending the horizontal direction is less than that between each of rotation centers of the first and second rotation plates and the suction passage extending the horizontal direction.

17. The cleaner of claim 14, wherein the at least one rotation plate includes a water blocking rib formed by protruding upward from an upper surface of the at least one rotation plate, and wherein, the water blocking rib is positioned outside the injection nozzle in a radial direction with respect to a rotational center of the at least one rotation plate.

18. The cleaner of claim 17, wherein the at least one rotation plate further includes a water passage hole through which water discharged from the injection nozzle passes, and wherein the water passage hole is disposed inside the water blocking rib based on the rotational center.

19. The cleaner of claim 14, wherein the lower surface of the nozzle body has a groove recessed upward from the lower surface of the nozzle body, and wherein the nozzle hole is formed in the groove.

20. The cleaner of claim 19, wherein the injection nozzle is provided at the nozzle hole and is disposed inside the groove.

21. The cleaner of claim 1, wherein the rotation cleaning part includes a first rotation cleaning part and a second rotation cleaning part spaced apart from each other in the horizontal direction of the nozzle body, wherein the water supply passage includes:

a supply tube through which water discharged from a discharge hole of the water tank flows;

a connector connected to the supply tube;

a first branch tube connected to the connector to supply water to the first rotation cleaning part; and a second branch tube connected to the connector to supply water to the second rotation cleaning part, and wherein the supply tube includes:

a first supply tube coupled to an inlet of the water pump; and a second supply tube coupled to an outlet of the water pump and the connector.

22. The cleaner of claim 1, wherein the water pump is positioned at the rear of the driving motor.

23. The cleaner of claim 22, wherein the water pump is positioned between the driving motor and the water adjusting unit.

* * * * *